US009026010B2

(12) United States Patent
Hiramatsu et al.

(10) Patent No.: US 9,026,010 B2
(45) Date of Patent: May 5, 2015

(54) IMAGE FORMING APPARATUS AND CARTRIDGE THAT IS ATTACHABLE TO AND DETACHABLE FROM THE IMAGE FORMING APPARATUS

(71) Applicant: Canon Kabushiki Kaisha, Tokyo (JP)

(72) Inventors: Daisuke Hiramatsu, Numazu (JP); Takashi Akutsu, Odawara (JP); Ken Kikuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 13/767,697

(22) Filed: Feb. 14, 2013

(65) Prior Publication Data

US 2013/0216258 A1 Aug. 22, 2013

(30) Foreign Application Priority Data

Feb. 17, 2012 (JP) ..... 2012-033412

(51) Int. Cl.
*G03G 15/08* (2006.01)
*G03G 21/16* (2006.01)

(52) U.S. Cl.
CPC ..... *G03G 21/1676* (2013.01); *G03G 21/1633* (2013.01)

(58) Field of Classification Search
USPC ..... 399/119, 111, 262
See application file for complete search history.

(56) References Cited

U.S. PATENT DOCUMENTS

| | | | | |
|---|---|---|---|---|
| 7,330,679 | B2 * | 2/2008 | Kweon | 399/111 |
| 7,738,817 | B2 * | 6/2010 | Sasae et al. | 399/258 |
| 7,983,597 | B2 * | 7/2011 | Kikuchi | 399/111 |
| 8,073,360 | B2 * | 12/2011 | Kikuchi | 399/111 |
| 8,634,743 | B2 * | 1/2014 | Akaike et al. | 399/110 |
| 2006/0159486 | A1 * | 7/2006 | Kweon | 399/110 |
| 2010/0098457 | A1 * | 4/2010 | Watanabe | 399/111 |
| 2010/0135691 | A1 * | 6/2010 | Kikuchi | 399/111 |
| 2011/0158681 | A1 * | 6/2011 | Kikuchi et al. | 399/111 |
| 2012/0020699 | A1 * | 1/2012 | Kamimura | 399/111 |

FOREIGN PATENT DOCUMENTS

| | | | |
|---|---|---|---|
| CN | 1740920 | A | 3/2006 |
| CN | 101075119 | A | 11/2007 |
| JP | 2007-219267 | A | 8/2007 |

* cited by examiner

*Primary Examiner* — G. M. Hyder
(74) *Attorney, Agent, or Firm* — Canon U.S.A., Inc. IP Division

(57) ABSTRACT

An image forming apparatus includes an image forming apparatus body and a cartridge attachable to and detachable from the image forming apparatus body. The cartridge includes a handle portion attached to the case body and grasped when attached to and detached from the image forming apparatus body. The handle portion can be positioned at a first position at which the handle portion protrudes beyond the case body, a second position at which the handle portion is closer to the case body than in the case where the handle portion is at the first position and the cartridge that has been attached to the image forming apparatus body comes into contact with the open-close portion when the open-close portion is closed, and a third position at which the handle portion is closer to the case body than in the case where the handle portion is at the second position.

19 Claims, 18 Drawing Sheets

IMAGE FORMING APPARATUS AND CARTRIDGE THAT IS ATTACHABLE TO AND DETACHABLE FROM THE IMAGE FORMING APPARATUS

BACKGROUND OF THE INVENTION

1. Field of the Invention

The present invention relates to a cartridge and an image forming apparatus to and from which the cartridge is attachable and detachable.

2. Description of the Related Art

Image forming apparatuses (electrophotographic image forming apparatuses) performing an electrophotographic image forming process employ a cartridge system with which a processing unit formed into a cartridge is attachable to and detachable from the image forming apparatus body as a single unit. Examples of the cartridge system include a development cartridge system in which a development cartridge contains a developing device such as a development roller. Examples of the development cartridge system include one in which a development cartridge functions as a process cartridge containing a photosensitive drum and one in which the apparatus body functions as a developing unit containing a drum. The development cartridge system allows users to perform maintenance of the apparatus by themselves without relying on servicing personnel. Thus, the development cartridge system is widely employed in electrophotographic image forming apparatuses.

In the case of the development cartridge system, users have to attach a development cartridge to the apparatus body or replace a development cartridge with a new one when the development cartridge is used up. In order for users to securely hold a development cartridge while handling the development cartridge, some development cartridges have a handle portion that is grasped by users. Some of the handle portions achieve a space-saving configuration by being easily graspable when they are attached to and detached from the development cartridge and tucked away when they are in the apparatus body (see Japanese Patent Laid-Open No. 2007-219267).

According to Japanese Patent Laid-Open No. 2007-219267, when a user replaces a development cartridge with a new one, the user opens a door of the image forming apparatus body, grasps a handle portion that is in a graspable state, and removes the development cartridge. Then, the user attaches a new development cartridge to the image forming apparatus body and closes the door, so that the handle portion rotates up to a retract position.

However, the existing cartridge has a disadvantage in that the handle portion of the cartridge detached from the apparatus body needs a large space during transportation in order to be kept in the graspable state.

SUMMARY OF THE INVENTION

The present invention provides an image forming apparatus including a cartridge that has a movable handle portion, the cartridge saving space during transportation and being easily graspable when being attached to or detached from an apparatus body.

An exemplary configuration of the image forming apparatus is an image forming apparatus including an image forming apparatus body; and a cartridge that is attachable to and detachable from the image forming apparatus body. The image forming apparatus body includes an open-close portion that is opened and closed to uncover and cover an opening through which the cartridge is attached to the image forming apparatus body. The cartridge includes a case body and a handle portion, the handle portion being attached to the case body and grasped when the cartridge is attached to and detached from the image forming apparatus body. The handle portion is capable of being positioned at a first position, a second position, and a third position, the first position being one at which the handle portion protrudes beyond the case body, the second position being one at which the handle portion is closer to the case body than in the case where the handle portion is at the first position, the second position being one at which the cartridge that has been attached to the image forming apparatus body comes into contact with the open-close portion when the open-close portion is closed, and the third position being one at which the handle portion is closer to the case body than in the case where the handle portion is at the second position. The handle portion is locked on the case body at the third position.

An exemplary configuration of the cartridge is a cartridge that is attachable to and detachable from an image forming apparatus body including an open-close portion that is openable and closeable to uncover and cover an opening through which the cartridge is attached to the image forming apparatus body. The cartridge includes a case body; and a handle portion attached to the case body, the handle portion being grasped when the cartridge is attached to and detached from the image forming apparatus body. The handle portion is capable of being positioned at a first position, a second position, and a third position, the first position being one at which the handle portion protrudes beyond the case body, the second position being one at which the handle portion is closer to the case body than in the case where the handle portion is at the first position, the second position being one at which the cartridge that has been attached to the image forming apparatus body comes into contact with the open-close portion when the open-close portion is closed, and the third position being one at which the handle portion is closer to the case body than in the case where the handle portion is at the second position. The handle portion is locked on the case body at the third position.

Further features of the present invention will become apparent from the following description of exemplary embodiments with reference to the attached drawings.

DESCRIPTION OF THE EMBODIMENTS

Embodiments

Embodiments according to the present invention will be described below in detail with reference to the drawings. Here, the dimensions, materials, shapes, and relative arrangements of components described in these embodiments are not intended to limit the scope of the invention to those described in the embodiments unless otherwise specified.

First Embodiment

An image forming apparatus according to a first embodiment of the present invention will be described with reference to the drawings.

Schematic of Image Forming Apparatus 100

Figure 1A:
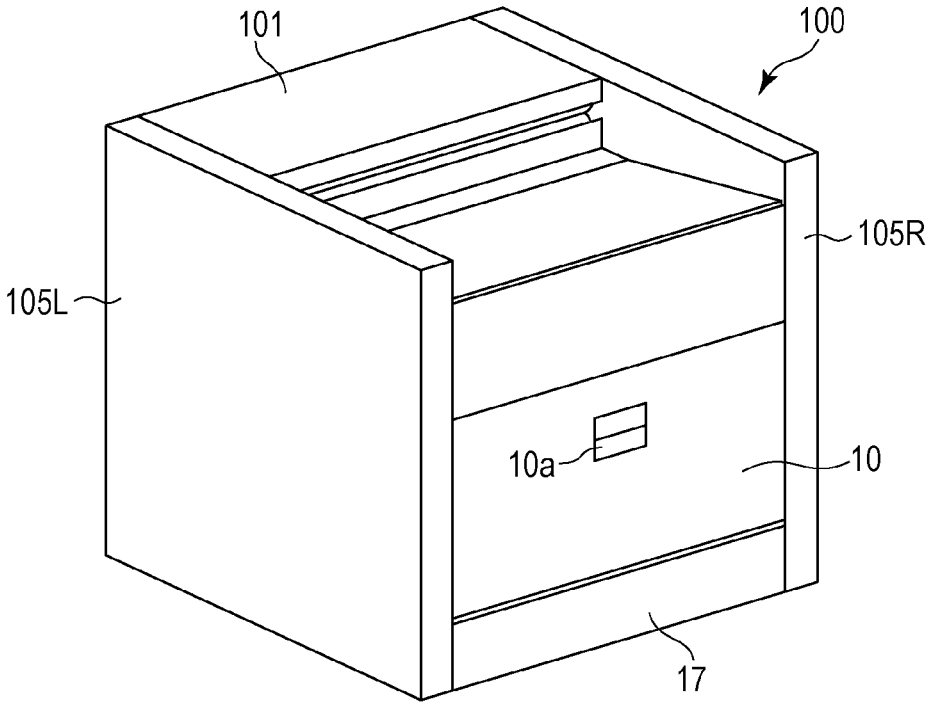
FIG. 1A is a perspective view of an image forming apparatus according to a first embodiment of the present invention.
Figure 1B:
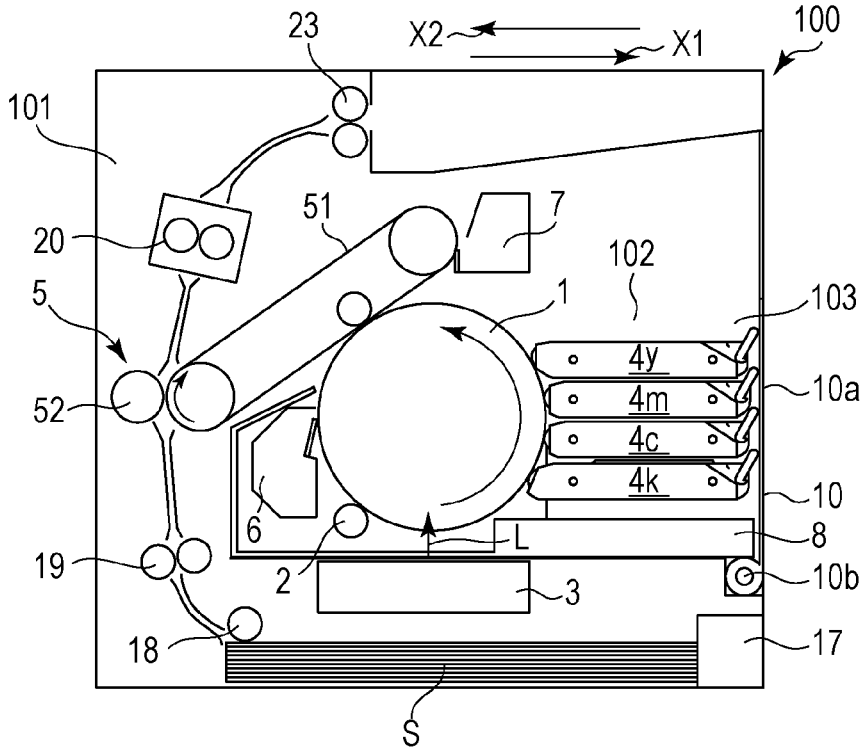
FIG. 1B illustrates a configuration of the image forming apparatus according to the first embodiment.

As illustrated in FIGS. 1A and 1B, an image forming apparatus 100 is a full color laser printer that prints in four colors by performing an electrophotographic process. Specifically, the image forming apparatus 100 forms an image on a recording medium S, which is in a sheet form, on the basis of an electrical image signal input to a control circuit (not illustrated) from a host device (not illustrated), such as a personal computer, an image reader, or a facsimile machine, to which the image forming apparatus 100 is connected.

In the following description, a front side of the image forming apparatus 100 is a side on which a door 10 (open-close portion) for opening and closing the apparatus is disposed. A rear side of the image forming apparatus 100 is a side opposite the front side. A front-rear direction includes directions extending from the rear side to the front side of the image forming apparatus 100 (or a front direction) and from the front side to the rear side (or a rear direction). A left side or a right side is the left side or the right side of the image forming apparatus when the image forming apparatus is viewed from the front side. A left-right direction includes directions extending from the right side to the left side (or a left direction) and from the left side to the right side (or a right direction). An apparatus body 101 is a portion of the image forming apparatus from which development cartridges 4 (4*y* to 4*k*) and a drum cartridge 8 are excluded. The development cartridges 4 each include a toner with which an electrostatic latent image formed on a photosensitive drum 1 is developed. Each development cartridge also includes a development roller that carries the toner.

Figure 3:
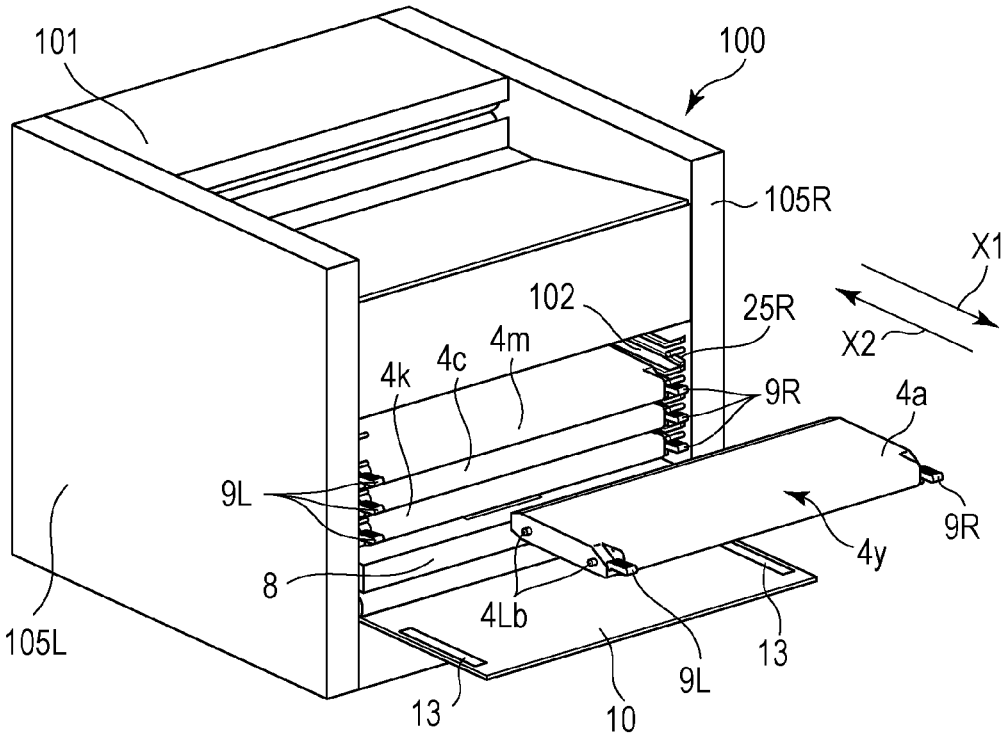
FIG. 3 illustrates attachment and detachment of a development cartridge according to the first embodiment.
Figure 4:
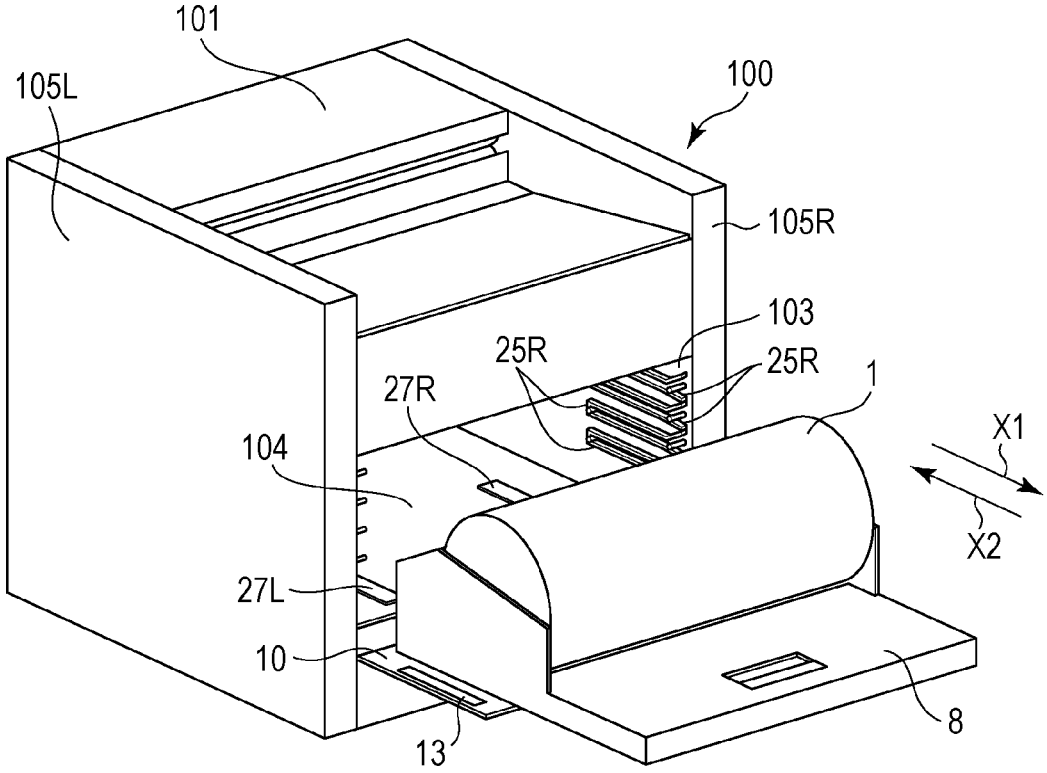
FIG. 4 illustrates attachment and detachment of a drum cartridge according to the first embodiment.

The image forming apparatus 100 according to the embodiment includes the development cartridges 4*y* to 4*k* and the drum cartridge 8. As illustrated in FIG. 3, the development cartridges 4*y* to 4*k* are detachably attached to a development cartridge receiving portion 102 of the image forming apparatus body 101 while the door 10 is open. As illustrated in FIG. 4, the drum cartridge 8 is detachably attached to a drum cartridge receiving portion 104 of the apparatus body 101 after the development cartridges 4*y* to 4*k* are removed and while the door 10 is open.

The drum cartridge 8 includes the photosensitive drum 1. The drum surface of the photosensitive drum 1 is charged by a charger 2 and is exposed to a laser beam L based on image information by an exposing device 3, so that an electrostatic latent image is formed on the surface. The electrostatic latent image is developed into toner images of different colors of yellow, magenta, cyan, and black by the development cartridges 4*y* to 4*k* by using toners of the corresponding colors. The toner images obtained by development are first-transferred to an intermediate transfer belt 51 of an intermediate transfer unit 5. Part of toner remaining on the photosensitive drum 1 after the first transfer is removed by a drum cleaning device 6.

A sheet S loaded on a feeding cassette 17 is transported by a feeding roller 18 and a pair of registration rollers 19 to a nip portion defined by a second transfer roller 52 and the intermediate transfer belt 51. At the nip portion, the toner images that have been first-transferred to the intermediate transfer belt 51 are second-transferred to the sheet S. The toner images transferred to the sheet S are fixed to the sheet S by a fixing portion 20 and the sheet S is discharged to the outside of the apparatus body by a pair of discharging rollers 23. Part of the toner remaining on the intermediate transfer belt 51 after the second transfer is removed by a belt cleaning device 7.

Replacement of Development Cartridges 4*y* to 4*k*

As illustrated in FIGS. 6A to 6C, 10A, and 10B, each of the development cartridges 4*y* to 4*k* includes a casing 4*a* (case), guided portions 4*b* (4Rb and 4Lb), and handle portions 9 (9R and 9L). The casing 4*a* has inclined portions 4*c* (4Rc and 4Lc) with which the handle portions 9 come into contact when the handle portions 9 are retracted.

Figure 2A:
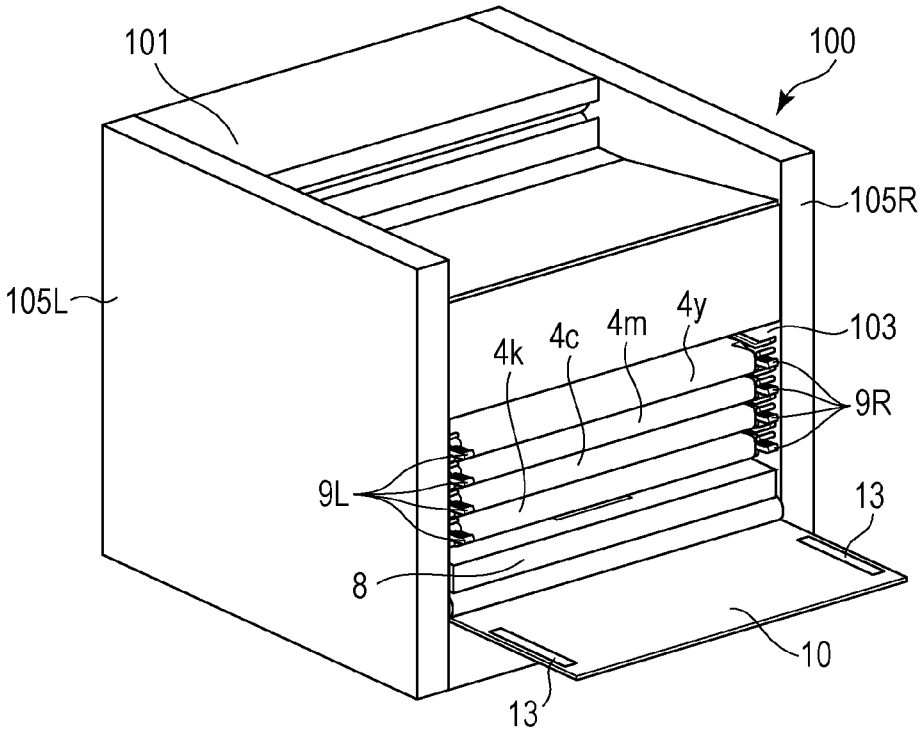
FIGS. 2A and 2B are perspective views of the image forming apparatus according to the first embodiment when the door is open.
Figure 2B:
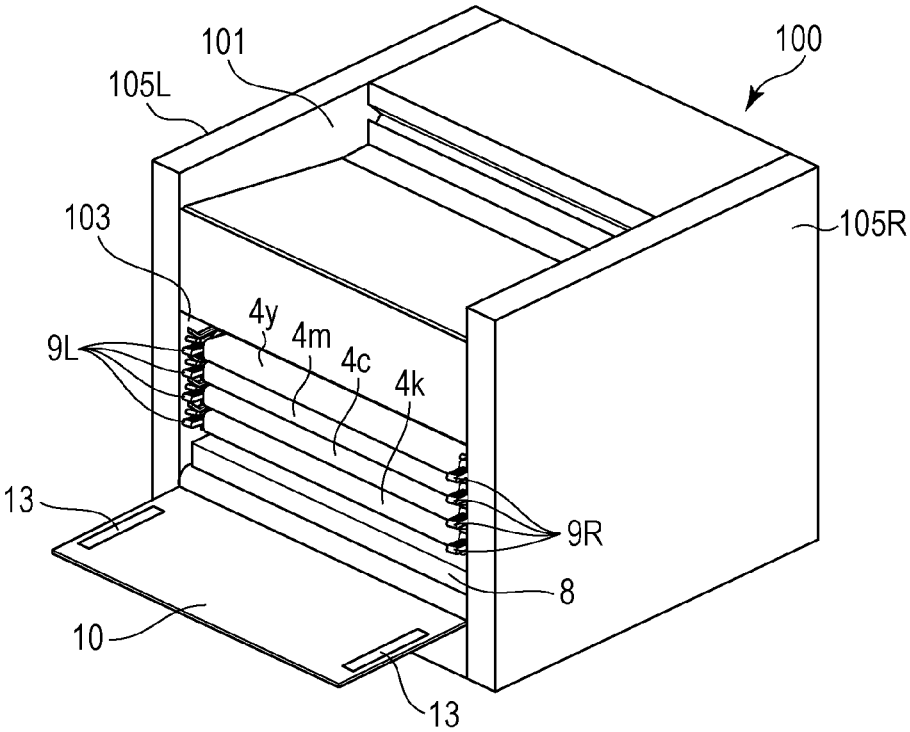
Figure 5A:
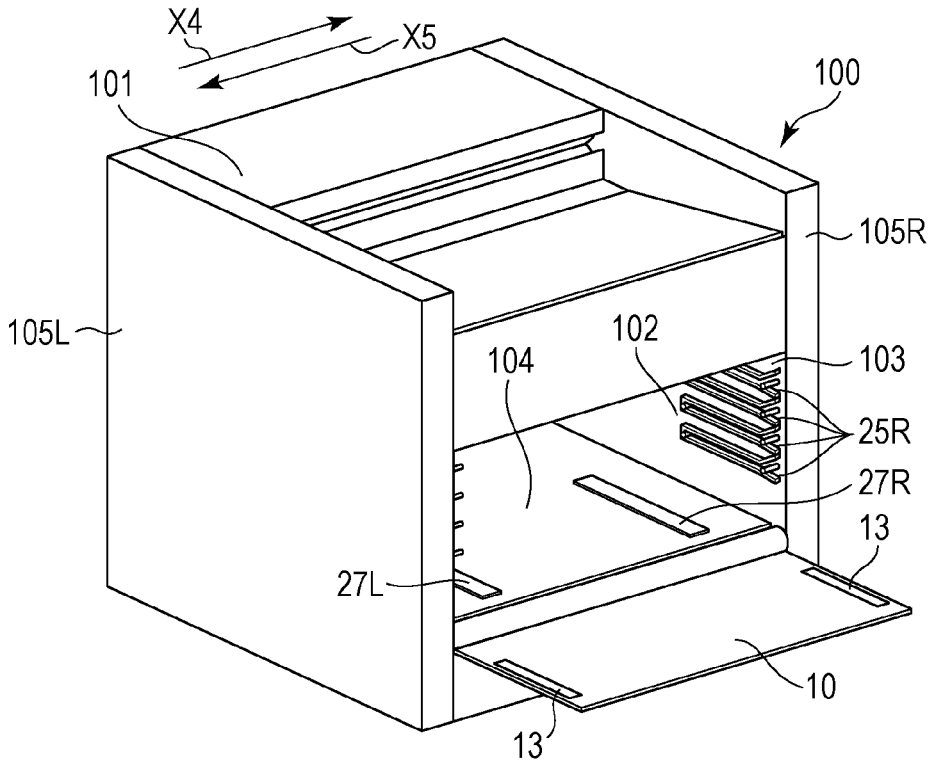
FIGS. 5A and 5B is a perspective view of the image forming apparatus from which the cartridges according to the first embodiment are removed.
Figure 5B:
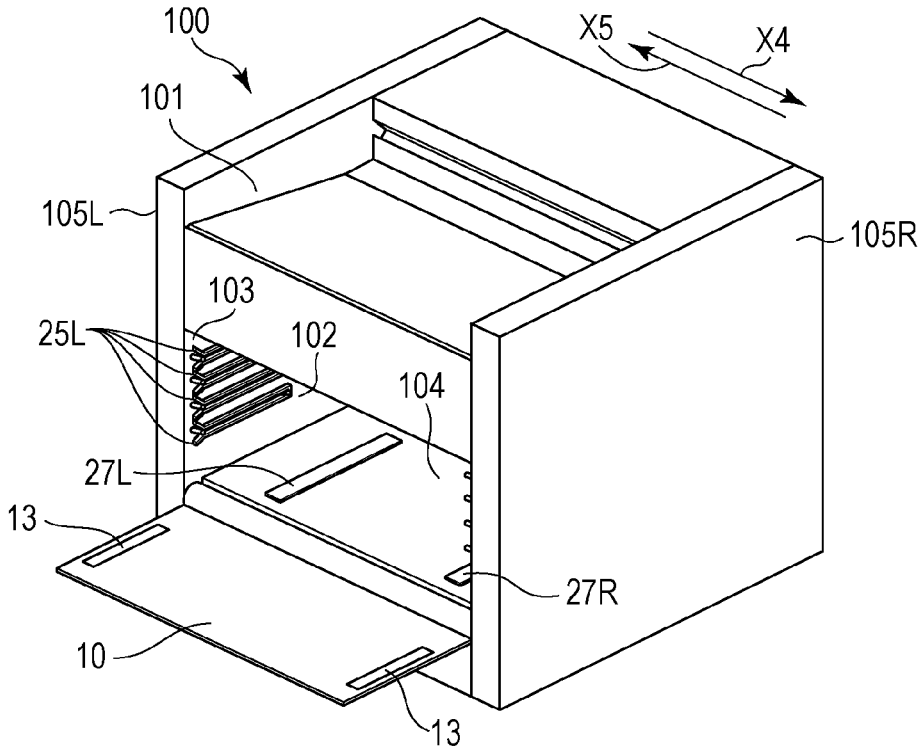

As illustrated in FIGS. 5A and 5B, an opening 103 is formed on the front side of the apparatus body 101. The opening 103 becomes accessible and inaccessible by rotating the door 10 relative to the apparatus body 101 around a hinge shaft 10*b* located at a lower side of the door. When a user opens the door 10 by grabbing a pull 10*a* of the door 10, the development cartridge receiving portion 102 becomes accessible as illustrated in FIGS. 2A and 2B. The state in which the door 10 does not cover the opening 103 such that the opening 103 is accessible is regarded as a state in which the door 10 is open, while the state in which the door 10 covers the opening 103 such that the opening 103 is inaccessible is regarded as a state in which the door 10 is closed.

As illustrated in FIGS. 5A and 5B, four pairs of guide rails 25 (25R and 25L) that extend horizontally are attached to inner surfaces of a right frame 105R and a left frame 105L of the apparatus body 101. The guide rails 25R individually face the guide rails 25L. The guide rails 25R and 25L are disposed such that, when the drum cartridge 8 is attached to the drum cartridge receiving portion 104, the drum 1 is positioned on a side that is further inward than the guide rails 25R and 25L. By allowing guided protrusions 4Rb and 4Lb of the development cartridges 4*y* to 4*k* to be guided along the guide rails 25R and 25L in the horizontal direction (directions of the arrows X1 and X2), the development cartridges 4*y* to 4*k* become attachable to and detachable from the development cartridge receiving portion 102.

As illustrated in FIG. 3, for replacement of the development cartridges 4*y* to 4*k*, the development cartridges 4*y* to 4*k* are detached from the image forming apparatus body 101 and new ones are attached to the image forming apparatus body 101. To detach the development cartridges 4*y* to 4*k* from the image forming apparatus body 101, a user opens the door 10, grasps the handle portions 9R and 9L that protrude into the opening 103, moves the development cartridges 4*y* to 4*k* from the development cartridge receiving portion 102 in a removal direction (X1 direction), removes the development cartridges 4*y* to 4*k* from the image forming apparatus body 101, and closes the door 10. To attach the development cartridges 4*y* to 4*k*, processing proceeds backward. Specifically, a user opens the door 10, attaches the development cartridges 4*y* to 4*k* to the development cartridge receiving portion 102 in an attachment direction (X2 direction) while grasping the handle portions 9R and 9L, pushes the development cartridges 4*y* to 4*k* up to a development position, and closes the door 10. A user can easily perform attachment and detachment of the development cartridges 4*y* to 4*k* by grasping the handle portions 9R and 9L without having to insert his/her hand into the image forming apparatus body 101.

Configuration of Handle Portions

Figure 6A:
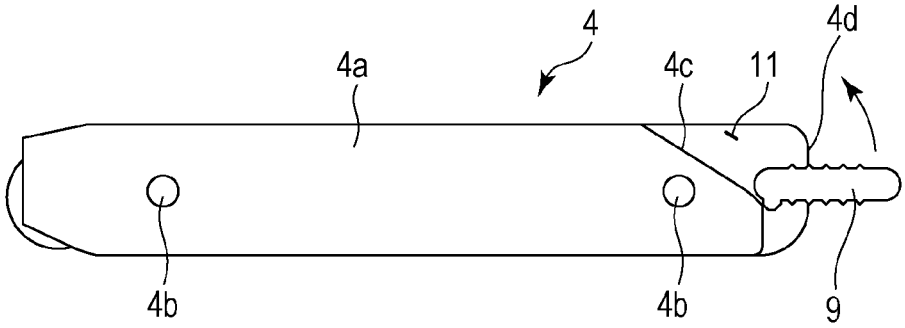
FIG. 6A is a left side view of the development cartridge according to the first embodiment with a handle portion of the development cartridge being at a first position.
Figure 6B:
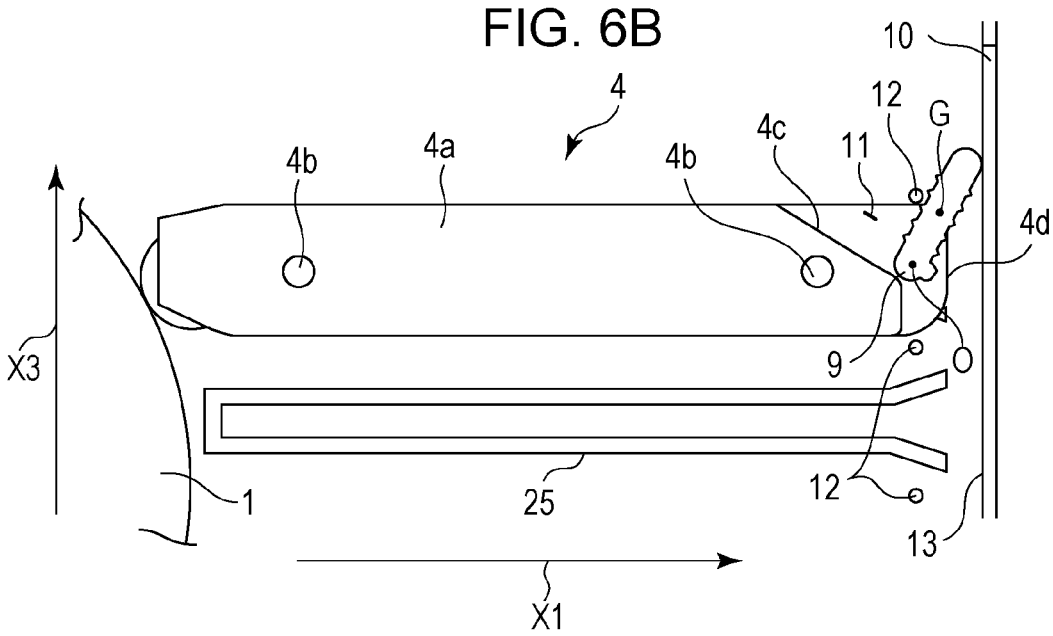
FIG. 6B is a left side view of the development cartridge according to the first embodiment with the handle portion of the development cartridge being at a second position.
Figure 6C:
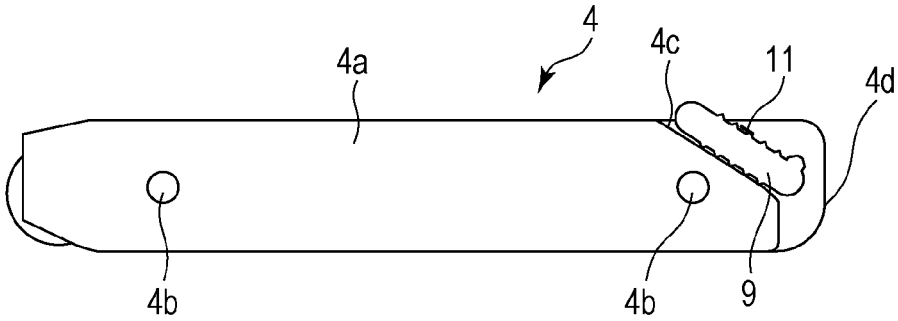
FIG. 6C is a left side view of the development cartridge according to the first embodiment with the handle portion of the development cartridge being at a third position.

As illustrated in FIGS. 6A to 6C, the handle portion 9 of the development cartridge 4 is rotatable between the first position and the third position via the second position. The handle portion 9 is at the first position while the development cartridge 4 is detached from the image forming apparatus body 101. The handle portion 9 is at the third position while the development cartridge 4 is transported. Details of these positions will be described below.

The first position illustrated in FIG. 6A is a position of the handle portion 9 while the development cartridge 4 is attached to or detached from the image forming apparatus body 101. When the handle portion 9 is at the first position, the handle portion 9 protrudes beyond an end portion 4*d* of the casing 4*a* in the removal direction (X1 direction). In the embodiment, when the development cartridge 4 has been attached to the development cartridge receiving portion 102 and the door 10 is not closed, the handle portion 9 is positioned at the first position. In the state where the development cartridge 4 has been attached to the development cartridge receiving portion 102 and the door 10 is not closed, the handle portion 9 protrudes outward beyond the opening 103. Since the handle portion 9 protrudes beyond the opening 103 and into the outside of the apparatus body 101, a user can replace the development cartridge 4 without having to insert his/her hand into the apparatus body 101. The handle portion 9 can be kept at the first position also when the development cartridge 4 is located outside the image forming apparatus body 101. An angle of the handle portion 9 at the first position with respect to the removal direction (X1 direction) is not specified and may be any angle at which, when the door 10 comes into contact with the handle portion 9 as a result of the door 10 being closed, the handle portion 9 smoothly rotates together with the door 10. Although not illustrated, the development cartridge 4 may include a locking portion with which, while the handle portion 9 is at the first position, the handle portion 9 can be locked and fixed at the first position.

The second position illustrated in FIG. 6B is the position of the handle portion 9 when the door 10 has been closed as a result of the door 10 and the handle portion 9 rotating together and when the development cartridge 4 has been attached to the development cartridge receiving portion 102. When the handle portion 9 is at the second position, the handle portion 9 is closer to the casing 4*a* than in the case where the handle portion 9 is at the first position. The amount by which the handle portion 9 at the second position protrudes beyond the end portion of the casing 4*a* is smaller than the amount by which the handle portion 9 at the first position protrudes beyond the end portion of the casing 4*a*. When the door 10 is closed, the handle portion 9 is rotated from the first position to the second position. This configuration allows space saving of the apparatus body 101. The angle of the handle portion 9 at the second position is not particularly specified and may be any angle between 0° to 90° provided that the angle of the removal direction (X1 direction) is 0° and the angle of the vertical direction (X3 direction) is 90° and at which the handle portion 9 rotates to the first position due to its weight when the handle portion 9 is not in contact with the door 10.

When each of the handle portions 9R and 9L is at the second position, the center of gravity G of the handle portion 9R or 9L is positioned above the center of rotation O of the handle portion 9R or 9L in the vertical direction (X3 direction) and on the side that is further outward than the center of rotation O in the horizontal direction (X1 direction). Consequently, when the door 10 is opened, the handle portions 9R and 9L rotate from the second position to the first position due to their weight.

The third position illustrated in FIG. 6C is the position of the handle portion 9 while the development cartridge 4 is transported. In this state, the handle portion 9 and the inclined portion 4*c* are in contact with each other. When the handle portion 9 is at the third position, the handle portion 9 is closer to the casing 4*a* than in the case where the handle portion 9 is at the second position. When the handle portion 9 is at the third position, the handle portion 9 does not protrude beyond the end portion of the casing 4*a*. Specifically, the amount by which the handle portion 9 at the third position protrudes beyond the end portion of the casing 4*a* is smaller than the amount by which the handle portion 9 at the second position protrudes beyond the end portion of the casing 4*a*. The handle portion 9 and the locking portion 11 are in contact with each other or almost in contact with each other. The locking portion 11, which will be described in detail below, is a component that is used to keep the handle portion 9 at the third position by being in contact with the handle portion 9. An external force of a certain magnitude or higher is required to deform the locking portion 11. When the handle portion 9 is at the third position, the handle portion 9 is positioned between the inclined portion 4*c* and the locking portion 11. Here, the handle portion 9 is either fixed by being locked by the locking portion 11 or almost incapable of rotating due to limited space for rotation. Thus, the handle portion 9 can be kept at the third position even when a small amount of external force or vibration occurs during transportation of the development cartridge 4. When the handle portion 9 is at the third position, the volume by which the handle portion 9 protrudes beyond the outer periphery of the casing 4*a* is smaller than that in the case where the handle portion 9 is at the first position or the second position (see FIGS. 6A to 6C). Since the development cartridge 4 can be transported with the handle portion 9 being at the third position, the development cartridge 4 can save space while being transported. The angle of the handle portion 9 at the third position is not particularly specified and may be any angle that is larger than the angle of the handle portion 9 at the second position.

Configuration of Handle Portion Locking Portion

Figure 7:
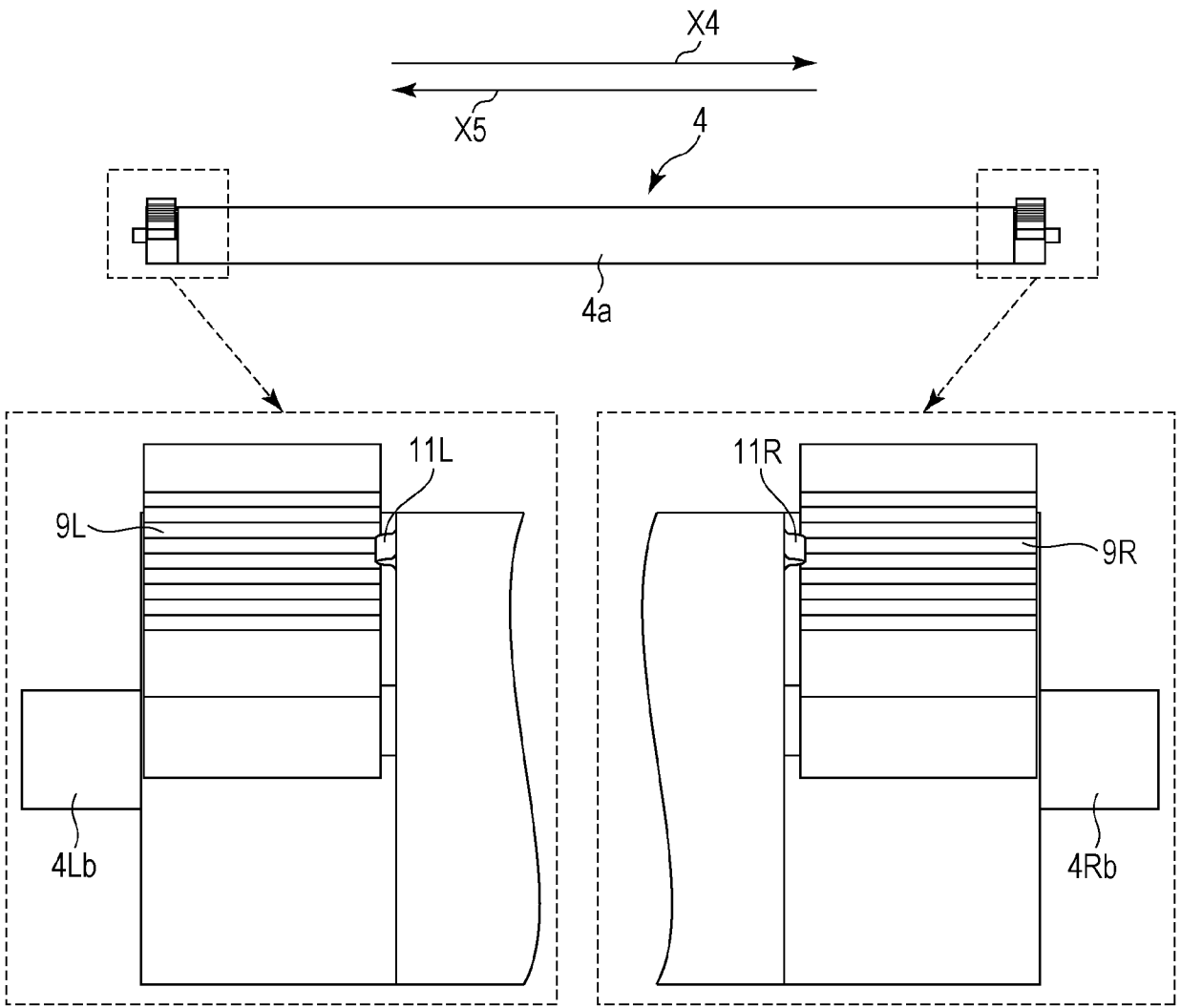
FIG. 7 illustrates the development cartridge according to the first embodiment with the handle portions being at the third position when viewed from the front and when part of the development cartridge is enlarged.

As illustrated in FIG. 7, the development cartridge 4 has locking portions 11 (11R and 11L) on both side surfaces. The locking portions 11 are used to fix the handle portions 9R and 9L at the third position.

The direction in which the image forming apparatus body 101 is viewed from the left side to the right side is defined as a X4 direction and the direction opposite the X4 direction is defined as a X5 direction. When the image forming apparatus body 101 is viewed in the X4 direction, the locking portion 11 is positioned such that the handle portion 9 overlaps the locking portion 11 while the handle portion 9 rotates between the third position and the second position as illustrated in FIGS. 6B and 6C. As illustrated in FIG. 7, the locking portion 11L protrudes in the X5 direction from the left side surface of the development cartridge 4 while the locking portion 11R protrudes in the X4 direction from the right side surface of the development cartridge 4. The amount by which each of the locking portions 11R and 11L protrudes in the X4 direction or the X5 direction is not particularly specified. It is only required that the locking portions 11R and 11L protrude by such an amount that the handle portions 9R and 9L come into contact with the locking portions 11R and 11L while rotating between the third position and the second position.

The shape and the material of the locking portion 11 is not particularly specified. The locking portion 11 may have any shape or may be made of any material as long as the locking portion 11 is deformed when receiving an external force of a certain magnitude or higher and restores its original shape when receiving no external force. Thus, when the locking portion 11 rotates from the third position to the second position or from the second position to the third position, the handle portion 9 comes into contact with the locking portion 11. Thus, the locking portion 11 is deformed by being pressed with an external force of a certain magnitude or higher, thereby allowing the handle portion 9 to rotate. When the handle portion 9 becomes no longer in contact with the locking portion 11 after rotating by a predetermined amount or more and the locking portion 11 becomes no longer pressed, the locking portion 11 restores its original shape.

When the handle portion 9 is at the third position, the locking portion 11 does not receive an external force and thus the locking portion 11 has its original shape. In this state, the locking portion 11 restricts the rotatable range of the handle portion 9 and thus the handle portion 9 does not rotate even when receiving a certain amount of external force or vibration. When a user tries to rotate the handle portion 9 from the third position to the first position, the user would fail to rotate the handle portion 9 if the user applies an external force of a magnitude lower than a certain magnitude to the locking portion 11 because the locking portion 11 is not deformed with the external force. When the user rotates the handle portion 9 by applying an external force of a certain magnitude or higher to the locking portion 11, the locking portion 11 is deformed by receiving the external force, so that the handle portion 9 is allowed to rotate or is unlocked. When the handle portion 9 is rotated further from that state toward the first position, the handle portion 9 becomes separated from the locking portion 11. In this embodiment, the state where the handle portion 9 stays between the inclined portion 4*c* and the locking portion 11 is defined as a locked state.

Unlocking Portion

In some cases, users attach the development cartridge 4 to the development cartridge receiving portion 102 without rotating the handle portion 9 of the development cartridge 4 to the first position. Examples of such a situation include one in which the handle portion 9 remains being locked by the locking portion 11 and one in which the handle portion 9 stays between the second position and the third position without being locked. If the development cartridge 4 is attached to the development cartridge receiving portion 102 with the handle portion 9 not being at the first position, a user has to insert his/her hand into the apparatus body 101 and rotate the handle portion 9 up to the first position by using his/her hand to remove the development cartridge 4 from the development cartridge receiving portion 102. In order to avoid such situations, the image forming apparatus 101 according to this embodiment includes unlocking portions that unlock the handle portion 9 positioned at the third position.

Figure 11:
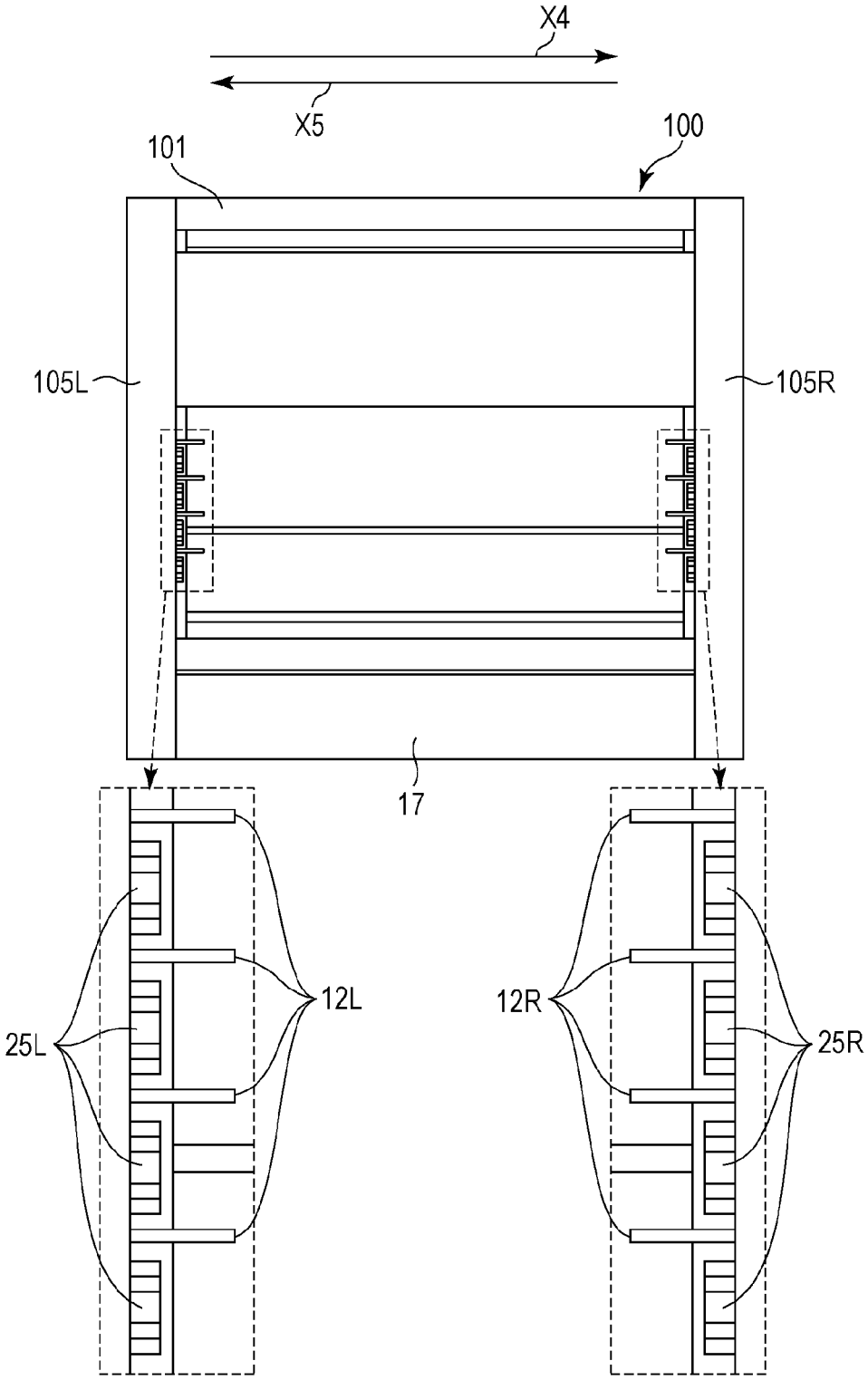
FIG. 11 illustrates the image forming apparatus according to the first embodiment from which the cartridges are removed when viewed from the front and when part of the image forming apparatus is enlarged.

As illustrated in FIG. 11, unlocking portions 12 (12R and 12L) are attached to the inner surfaces of the right frame 105R and the left frame 105L of the image forming apparatus 101. The unlocking portions 12R and 12L are attached to the right frame 105R and the left frame 105L at such positions as to correspond to the handle portions 9R and 9L of the development cartridges 4*y* to 4*k*.

Figure 8A:
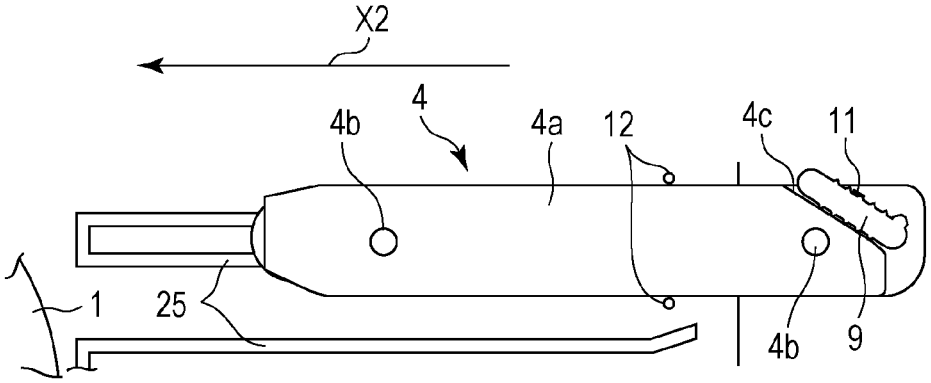
FIGS. 8A to 8C are left side views of the development cartridge according to the first embodiment in the course of being attached to the image forming apparatus body with the handle portion being positioned at the third position.
Figure 8B:
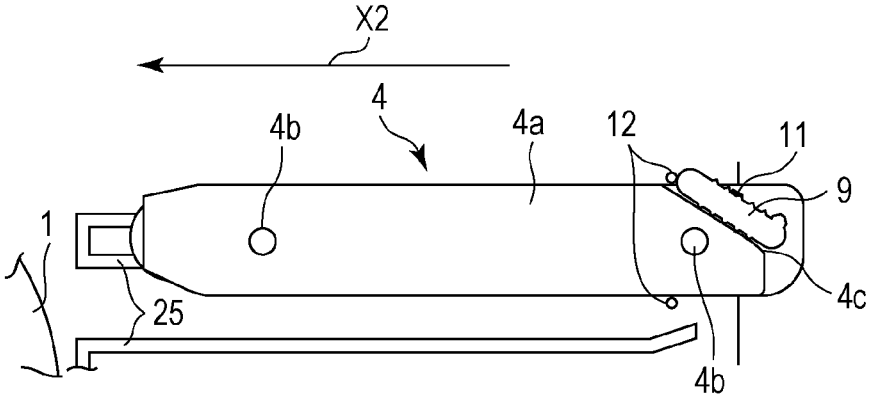
Figure 8C:
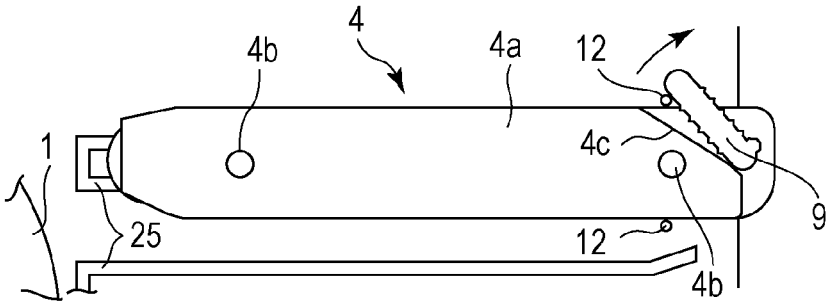

The unlocking portions 12R horizontally extend in the X5 direction from the inner surface of the right frame 105R. As illustrated in FIGS. 8A to 8C, the unlocking portions 12 have a circular shape when viewed from the left side surface in the embodiment, but may have another shape as long as the unlocking portions 12 can function similarly. The length of the unlocking portions 12R in the X5 direction is not particularly specified. The unlocking portions 12R may have any length as long as the unlocking portions 12R can come into contact with the handle portion 9R when the handle portion 9R is positioned between the third position and the second position during attachment of each of the development cartridges 4*y* to 4*k* and as long as the unlocking portions 12R have such strength as not to be damaged when receiving an external force to unlock the handle portion 9R. As illustrated in FIG. 11, the unlocking portions 12L extend in the X4 direction from the inner surface of the left frame 105L. The length of the unlocking portions 12L in the cross-sectional direction (the X4 direction) is not particularly specified. The unlocking portions 12L may have any length as long as the unlocking portions 12L can come into contact with the handle portion 9L when the handle portion 9L is positioned between the third position and the second position and as long as the unlocking portions 12L have such strength as not to be damaged when receiving an external force to unlock the handle portion 9L.

Secure Unlocking of Handle Portion from Retraction Position

After a user unwraps the development cartridges 4*y* to 4*k* that have been in a transportation state, the user usually moves the handle portions 9 from the third position to the first position and then attaches the development cartridges 4*y* to 4*k* to the development cartridge receiving portion 102 while grasping the handle portions 9. In this embodiment, however, even when a user does not perform the above operations, the handle portions 9 can be rotated up to the first position by fully attaching the development cartridges 4*y* to 4*k* to the development cartridge receiving portion 102. Details of this mechanism will be described below.

As illustrated in FIG. 8A, when the development cartridge 4 is moved in the X2 direction to be attached to the development cartridge receiving portion 102 while the handle portion 9 is locked by the locking portion 11 at the third position, the unlocking portion 12 comes into contact with a contact portion of the handle portion 9 as illustrated in FIG. 8B. When an external force of a certain magnitude of higher is applied to the locking portion 11 in this state, the locking portion 11 is deformed and the handle portion 9 is allowed to rotate or is unlocked. Immediately after the handle portion 9 is unlocked, the handle portion 9 and the unlocking portion 12 remain in contact with each other. Thereafter, when the development cartridge 4 is further pressed into the development cartridge receiving portion 102 in the attachment direction (X2 direction), the handle portion 9 is rotated relative to the unlocking portion 12 toward the first position by being supported by the unlocking portion 12, as illustrated in FIG. 8C. As the handle portion 9 rotates and the angle of the handle portion 9 becomes smaller than 90° provided that the angle of the removal direction (X1 direction) is 0° and the angle of the vertical direction is 90°, the handle portion 9 moves to the first position due to its weight. The handle portion 9 moves due to its weight because the center of gravity G of the handle portion 9 is positioned above the center of rotation O of the handle portion 9 in the vertical direction (X3 direction) and on the side that is closer to the door 10 than the center of rotation O in the horizontal direction. The handle portion 9 rotates in the same manner in the case where the development cartridge 4 is attached to the development cartridge receiving portion 102 with the handle portion 9 being positioned at a position between the second and third positions at which the handle portion 9 is not locked by the locking portion 11. As described above, after the development cartridge 4 is fully attached to the development cartridge receiving portion 102, the handle portion 9 is positioned at the first position wherever the handle portion 9 has been positioned before the attachment. This configuration causes the handle portion 9 to rotate to the first position even when a user attaches the development cartridge 4 that has been in the transportation state to the development cartridge receiving portion 102 by grasping portions other than the handle portion 9 without rotating the handle portion 9 to the first position. Consequently, the user does not have to insert his/her hand into the image forming apparatus body 101 and rotate the handle portion 9 to the first position in order to remove the development cartridge 4.

Configuration of Door

As illustrated in FIGS. 2A and 2B, handle portion contact portions 13 are attached to an inner surface of the door 10, which faces the inside of the image forming apparatus body 101 when the door 10 is closed. The handle portion contact portions 13 have the same shape. The handle portion contact portions 13 are positioned so as to come into contact with the handle portions 9 when the door 10 is closed. The material of the handle portion contact portions 13 is not particularly specified. The handle portion contact portions 13 may be made of any material that can absorb shock or sound that is produced when the handle portion contact portions 13 come into contact with the handle portions 9. Examples of the handle portion contact portions 13 include elastic members such as springs or rubber products. In this embodiment, one handle portion contact portion 13 is disposed on the left side and another handle portion contact portion 13 is disposed on the right side. Instead, each handle portion contact portion 13 may be divided into some pieces such that the number of pieces corresponds to the number of development cartridges 4. Furthermore, the handle portion contact portions 13 may have different shapes as long as they can function similarly. Note that in the case where the inner surface of the door 10 is made of a material that can absorb shock or sound that is produced when the handle portion contact portions 13 come into contact with the handle portions 9, the handle portion contact portions 13 may be excluded and the handle portions 9 may directly come into contact with the door 10.

Collective Movement of Door and Development Cartridge Handle Portion

Figure 9A:
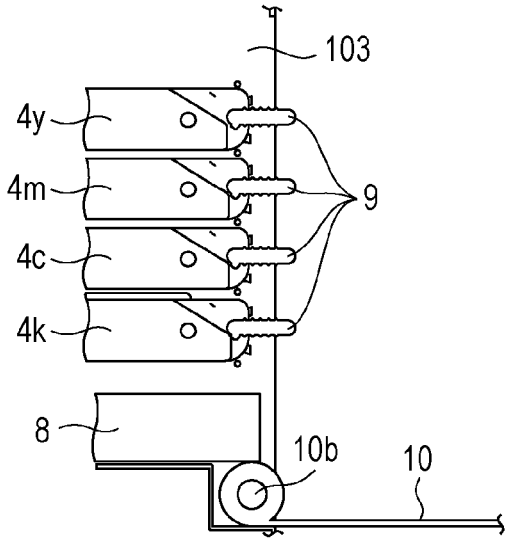
FIG. 9A is a left side view of the image forming apparatus body when the door according to the first embodiment is open.
Figure 9B:
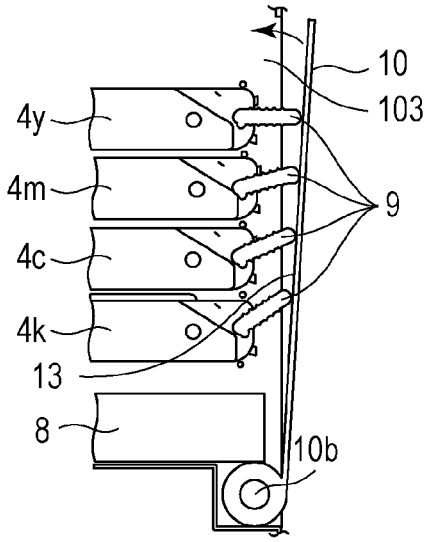
FIG. 9B is a left side view of the image forming apparatus body when a handle portion contact portion of the door according to the first embodiment comes into contact with the handle portion as a result of the door being closed.
Figure 9C:
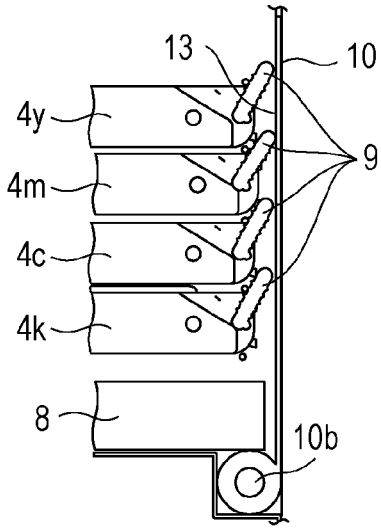
FIG. 9C is a left side view of the image forming apparatus body when the door according to the first embodiment is completely closed.
Figure 10A:
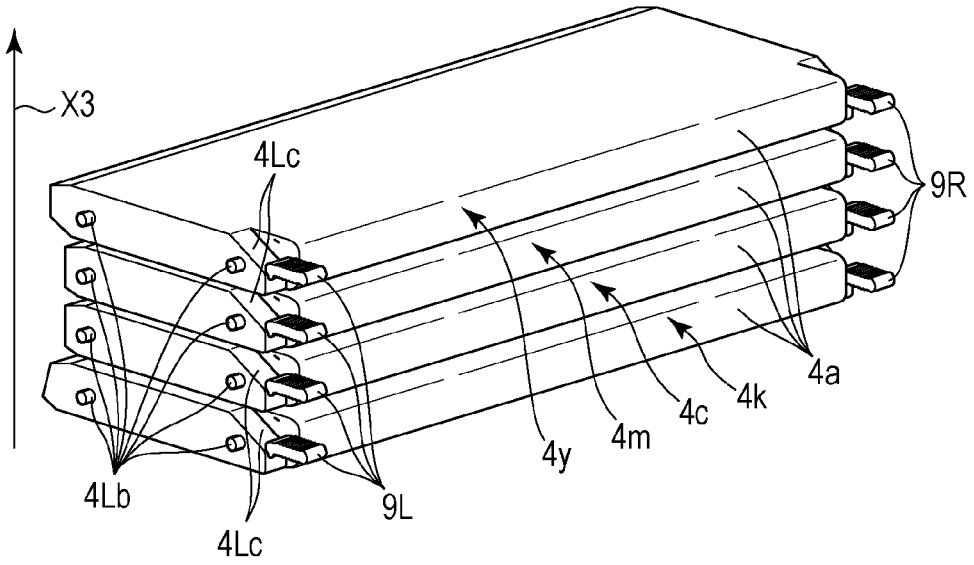
FIGS. 10A and 10B are perspective views of multiple development cartridges according to the first embodiment.
Figure 10B:
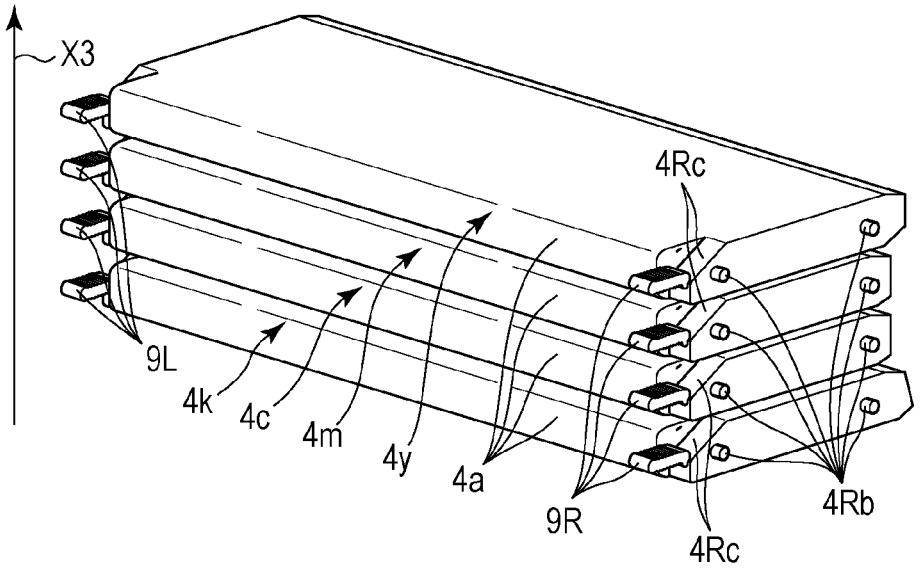

As illustrated in FIGS. 9A to 9C, while the development cartridges 4*y* to 4*k* are attached to the development cartridge receiving portion 102 and the handle portion contact portions 13 are in contact with the handle portions 9 as a result of rotation of the door 10, the door 10 and the handle portions 9 rotate together.

As illustrated in FIG. 9A, when the handle portion contact portions 13 of the door 10 are not in contact with the handle portions 9 when the development cartridges 4*y* to 4*k* have been attached to the development cartridge receiving portion 102, the door 10 and the handle portions 9 do not rotate together. In this state, the handle portions 9 are at the first position.

As illustrated in FIG. 9B, in the course of rotating the door 10 from an open position toward a closed position, the handle portion contact portion 13 of the door 10 comes into contact with the handle portions 9 when the door 10 is rotated by a certain angle. Then, the door 10 and the handle portions 9 can rotate together. While the door 10 moves from a position at this angle to the fully closed position, the door 10 and the handle portions 9 rotate together.

As illustrated in FIG. 9C, when the door 10 is fully rotated up to the closed position, the opening 103 is completely covered with the door 10. In this state, the handle portion contact portions 13 of the door 10 and the handle portions 9 are in contact with one another. Here, the handle portions 9 are at the second position.

With reference to FIGS. 9A, 9B, and 9C, transition from the state where the door 10 is open to the state where the door 10 is closed has been described above in the order of FIGS. 9A, 9B, and 9C. On the other hand, transition from the state where the door 10 is closed to the state where the door 10 is open proceeds in the opposite order, that is, in the order of FIGS. 9C, 9B, and 9A. Here, the handle portions 9 move in the direction opposite the direction in which the handle portions 9 move when the door is closed.

Replacement of Drum Cartridge 8

As described above, the drum cartridge 8 is attached to and detached from the drum cartridge receiving portion 104 while the door 10 is open and after the development cartridges 4*y* to 4*k* are removed as illustrated in FIG. 4. The drum cartridge 8 is guided along right and left guide rails 27R and 27L attached to the bottom surface of the apparatus body 101 in the removal direction (X1 direction) or in the attachment direction (X2 direction) and is attached to or detached from the drum cartridge receiving portion 104.

Second Embodiment

Now, a second embodiment of the present invention will be described.

In the second embodiment, locking portions 14 (14R and 14L) are used instead of the locking portions 11 according to the first embodiment. Other components are the same as those of the first embodiment. These components are denoted by the same reference symbols and will not be described.

Configuration of Handle Portion

Figure 14A:
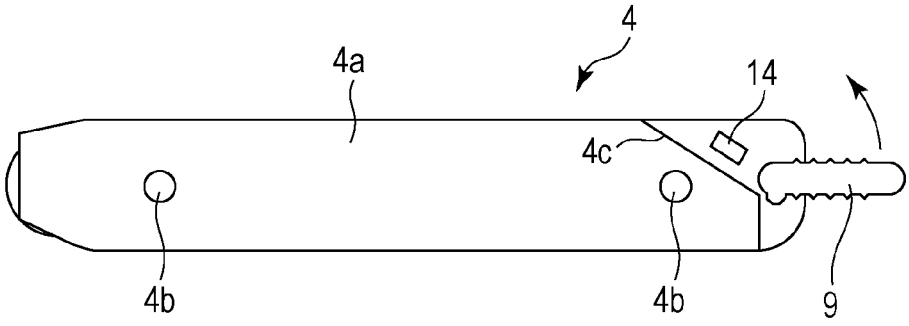
FIG. 14A is a left side view of the development cartridge according to the second embodiment with the handle portion of the development cartridge being at a first position.
Figure 14B:
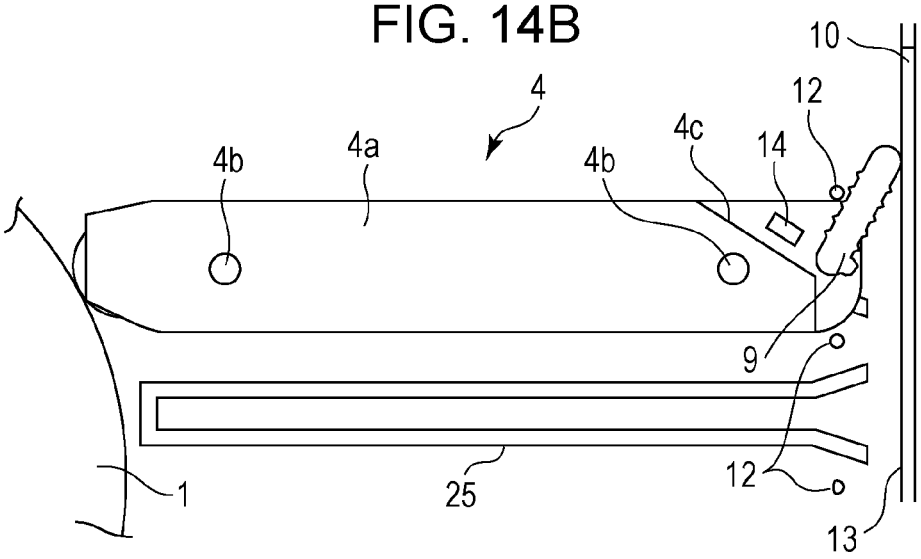
FIG. 14B is a left side view of the development cartridge according to the second embodiment with the handle portion of the development cartridge being at a second position.
Figure 14C:
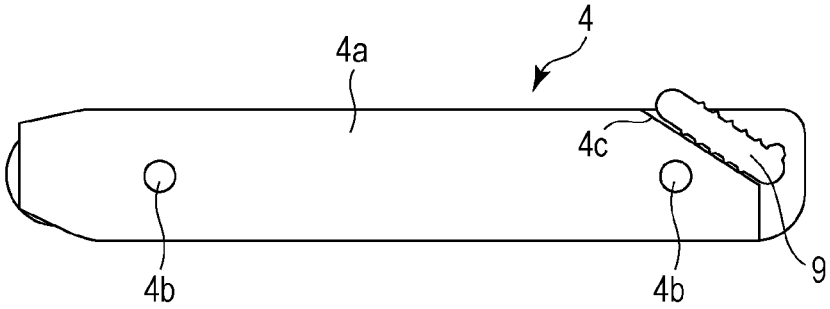
FIG. 14C is a left side view of the development cartridge according to the second embodiment with the handle portion of the development cartridge being at a third position.

FIGS. 14A to 14C illustrate the handle portion 9 according to the second embodiment at the first, second, and third positions. Here, the first position and the second position are the same as those in the first embodiment.

When the handle portion 9 is at the third position as illustrated in FIG. 14C, the handle portion 9 and the locking portion 14 are in contact with each other. At the third position, the handle portion 9 is locked and fixed by the locking portion 14. The position up to which the handle portion 9 is pressed and beyond which the handle portion 9 cannot rotate is the third position. In the first embodiment, there is a space in which the handle portion 9 is rotatable by a certain amount while the handle portion 9 is locked by the locking portion 11. However, in the second embodiment, when the handle portion 9 is locked by the locking portion 14, the handle portion 9 is fixed. Consequently, a sound that would be produced due to rotation of the handle portion 9 in the rotatable space can be reduced or the inclined portions 4*c* or the locking portion 11 can be prevented from being damaged during transportation of the development cartridge 4.

Configuration of Handle Portion Locking Portion

Figure 12:
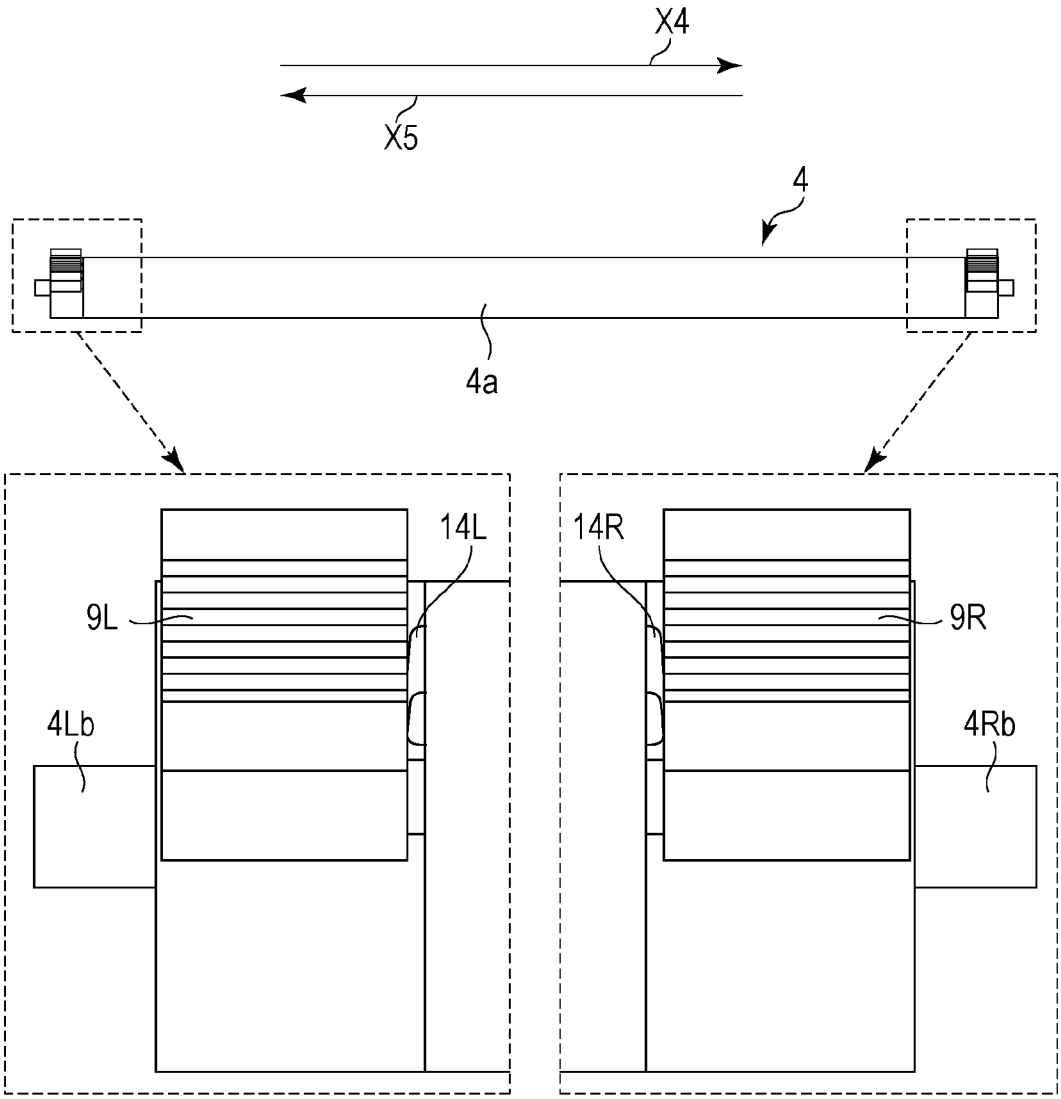
FIG. 12 illustrates a development cartridge according to a second embodiment with the handle portions being at the third position when viewed from the front and when part of the development cartridge is enlarged.

As illustrated in FIG. 12, the development cartridge 4 has locking portions 14R and 14L on both side surfaces to fix the handle portions 9R and 9L at the third position.

When viewed from the left side surface as illustrated in FIGS. 14A to 14C, the locking portion 14 is positioned such that the handle portion 9 covers the locking portion 14 when the handle portion 9 is at the third position. As illustrated in FIG. 12, the locking portion 14L protrudes in the X5 direction while the locking portion 14R protrudes in the X4 direction. The amount by which each of the locking portions 14R and 14L protrudes in the X4 direction or the X5 direction is not particularly specified. It is only required that the locking portions 14R and 14L protrude by such an amount as to come into contact with the handle portions 9R and 9L and as to be pressure-inserted into the handle portions 9R and 9L when the handle portions 9R and 9L are at the third position.

Figure 13A:
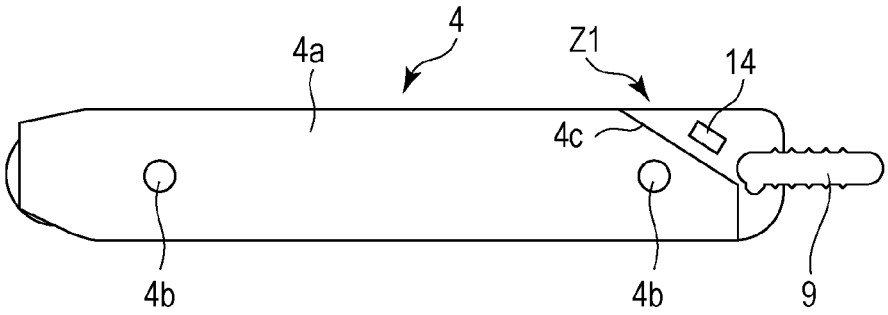
FIG. 13A is a left side view of the development cartridge according to the second embodiment with the handle portion being at the first position.
Figure 13B:
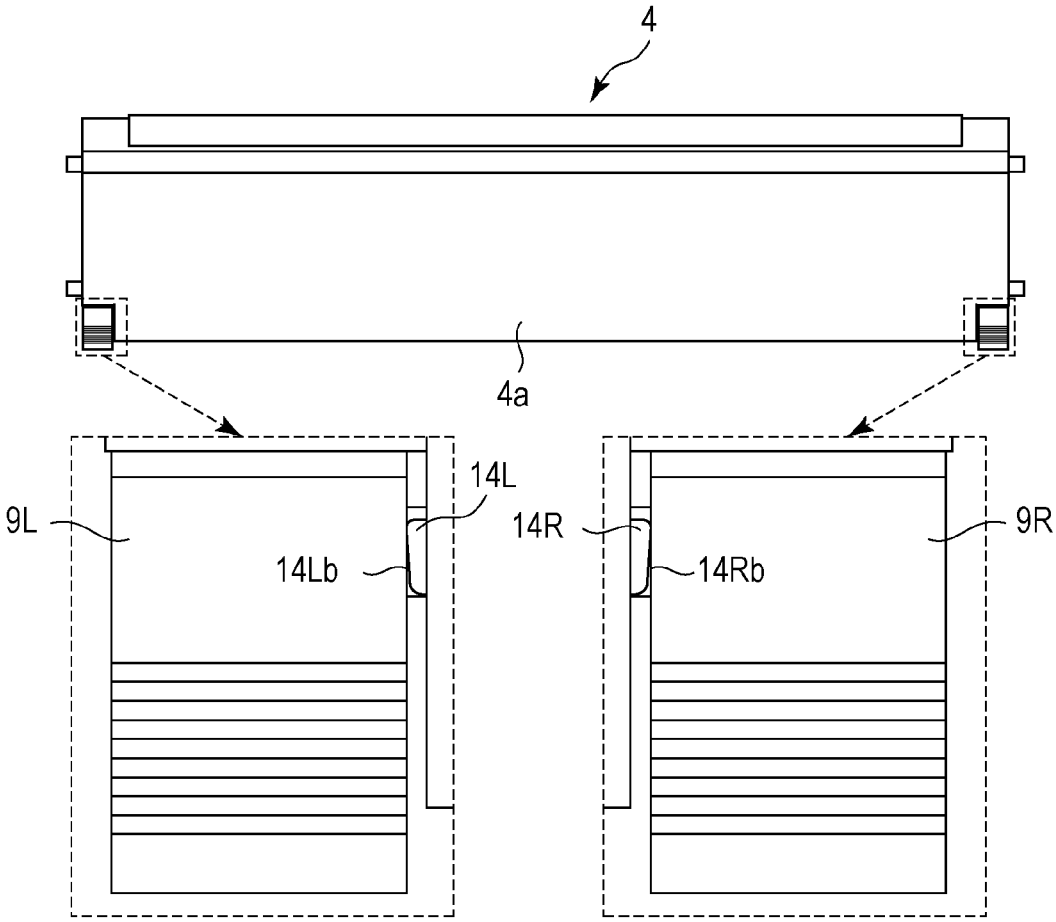
FIG. 13B is the development cartridge according to the second embodiment with the handle portions being at the first position when viewed in the direction of the arrow Z1 and when part of the development cartridge is enlarged.

As illustrated in FIG. 13B, the locking portions 14R and 14L individually have slopes 14Rb and 14Lb so that the locking portions 14R and 14L can be easily pressure-inserted into the handle portions 9R and 9L when the handle portions 9R and 9L rotate from the second position to the third position. An angle of each of the slopes 14Rb and 14Lb is not particularly specified. By also taking the amount by which the locking portions 14R and 14L protrude into consideration, the angle of the slopes 14Rb and 14Lb only has to be determined such that, while the handle portions 9R and 9L are at the third position at which the handle portions 9R and 9L do not receive an external force of a certain magnitude or higher, the handle portions 9R and 9L do not rotate from the third position.

Third Embodiment

Now, a third embodiment of the present invention will be described.

The third embodiment differs from the first embodiment with regard to the following points. The shape of the casing 4*a* of each of the development cartridges 4*y* to 4*k* is changed. Specifically, the shape of the casing 4*a* is changed by excluding the inclined portion 4*c*. The structure of contact portions (referred to as "unlocking portion contact portions") 9*a* (9Ra and 9La) of each of the development cartridge handle portions 9R and 9L that come into contact with the unlocking portions is changed. The handle portions 9R and 9L and the locking portions 11R and 11L are arranged at different positions. The shape of the handle portion contact portions 13 is changed. The unlocking portions 12 are substituted by unlocking portions 15 (15R and 15L). Other components are the same as those of the first embodiment. Thus, these same components are denoted by the same reference symbols and will not be described.

Configuration of Handle Portion

Figure 16A:
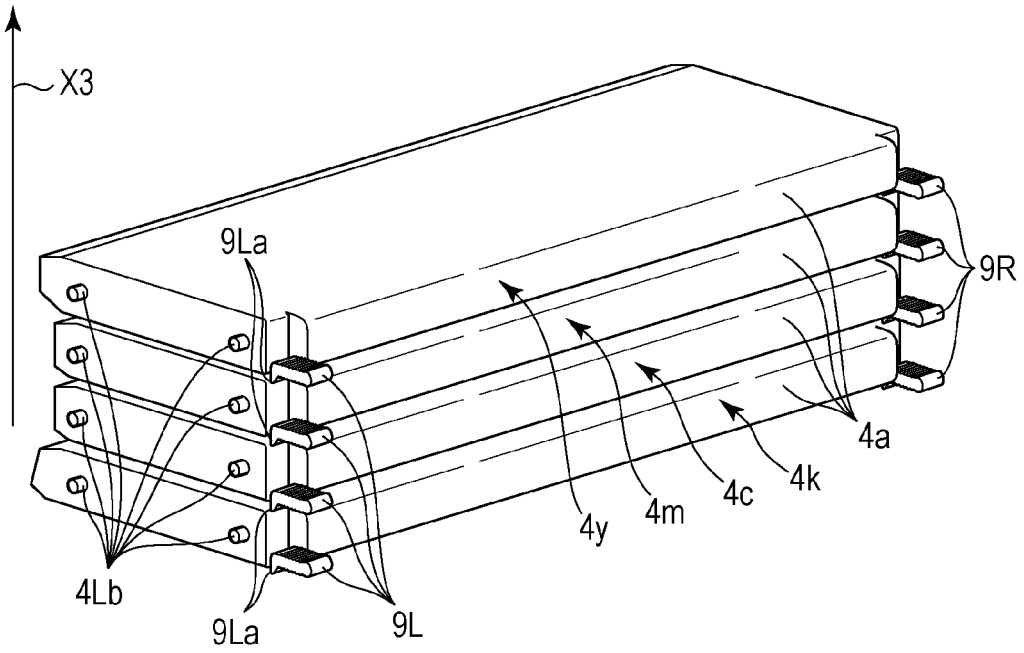
FIGS. 16A and 16B are perspective views of multiple development cartridges according to the third embodiment.
Figure 16B:
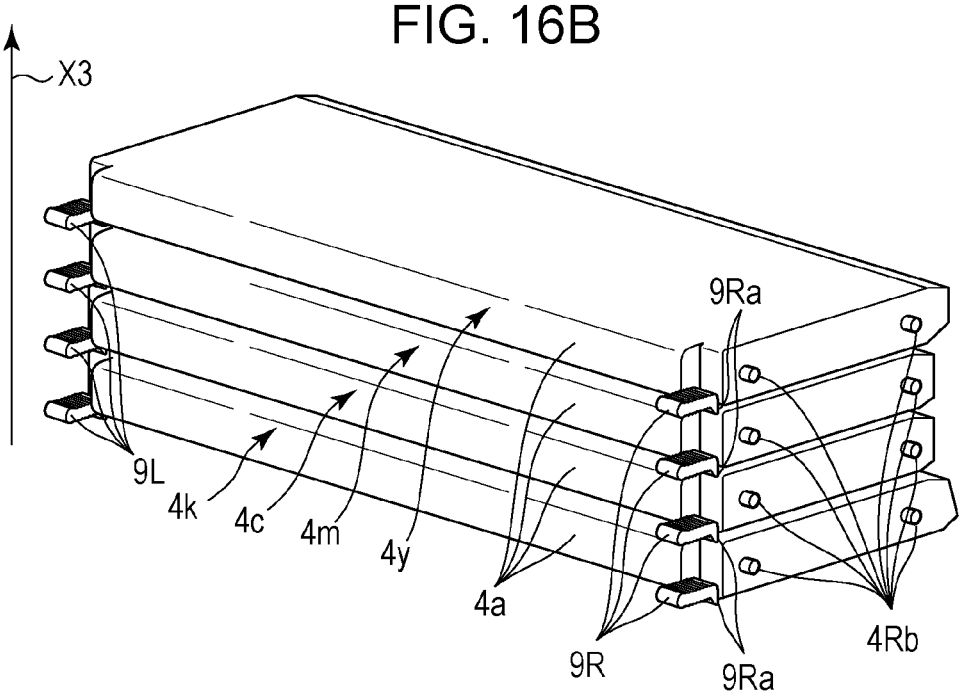

As illustrated in FIGS. 16A and 16B, each of the development cartridges 4*y* to 4*k* does not include the inclined portions 4*c* and the shape of the casing 4*a* is changed. With this change in shape of the casing 4*a*, the range within which the handle portions 9R and 9L can rotate is changed.

Figure 15A:
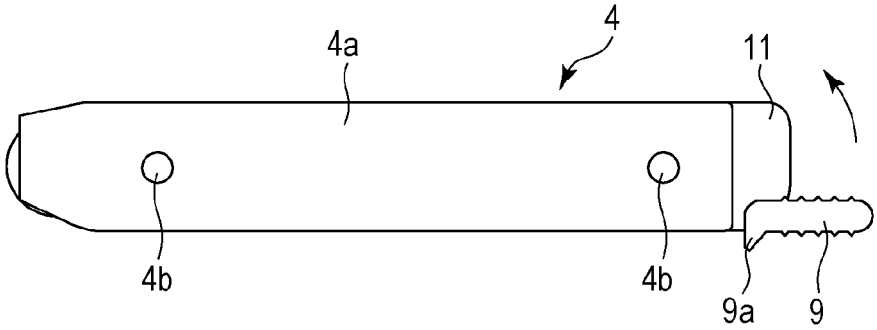
FIG. 15A is a left side view of a development cartridge according to a third embodiment with a handle portion of the development cartridge being at a first position.
Figure 15B:
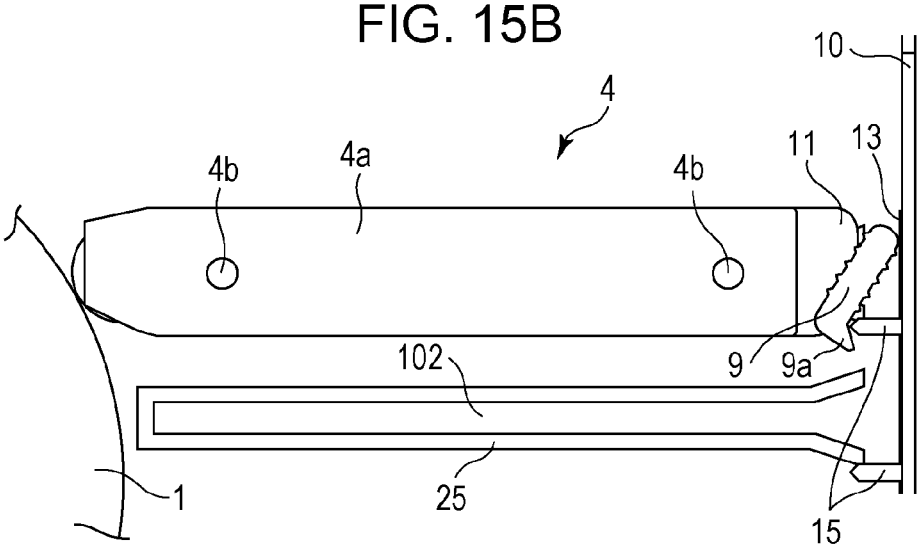
FIG. 15B is a left side view of the development cartridge according to the third embodiment with the handle portion of the development cartridge being at a second position.
Figure 15C:
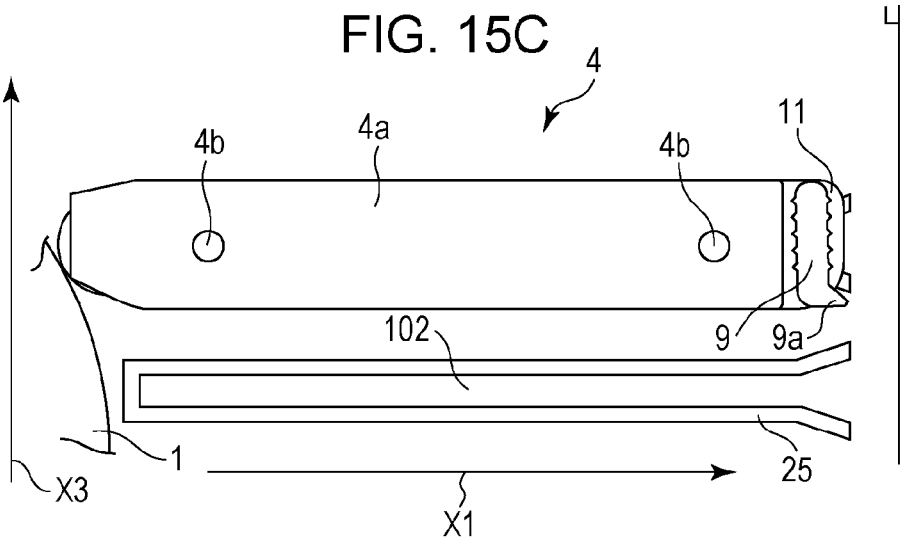
FIG. 15C is a left side view of the development cartridge according to the third embodiment with the handle portion of the development cartridge being at a third position.

FIGS. 15A to 15C illustrate the handle portion 9 according to the third embodiment at the first, second, and third positions. Here, the first position (FIG. 15A) and the second position (FIG. 15B) are the same as those in the first embodiment.

FIG. 15C is a left side view of the development cartridge 4 when the handle portion 9 is positioned at the third position. While the development cartridge 4 is attached to the development cartridge receiving portion 102, the angle of the handle portion 9 at the third position is set at 90° provided that the angle of the removal direction (X1 direction) is 0° and the angle of the vertical direction (X3 direction) is 90°. Thus, in this embodiment, the height of the handle portion 9 in the X3 direction is largest when the handle portion 9 is at the third position. The height of the handle portion 9 in the X3 direction at the third position is smaller than the dimension of the casing 4*a* in the X3 direction. Here, the angle of the handle portion 9 at the third position with respect to the removal direction (X1 direction) may be larger than 90° but not larger 180°. The angle of the handle portion 9 at the third position at which the height of the handle portion 9 in the X3 direction becomes largest as a result of rotation of the handle portion 9 may be any angle as long as the largest height of the handle portion 9 in the X3 direction is smaller than the dimension of the casing 4*a* in the X3 direction. Alternatively, the angle of the handle portion 9 at the third position with respect to the removal direction (X1 direction) may be smaller than 90° as long as the angle is larger than the angle of the handle portion 9 at the second position. This embodiment differs from the first and second embodiments in that, while the development cartridge 4 is attached to the development cartridge receiving portion 102, the height of the handle portion 9 in the X3 direction is smaller than the dimension of the casing 4*a* in the X3 direction and accordingly the handle portion 9 does not protrude beyond the casing 4*a*. Thus, the development cartridge 4 saves more space than that according to the first or second embodiment.

As illustrated in FIGS. 15A to 15C, 16A, and 16B, the handle portions 9R and 9L are arranged at positions different from those in the case of the first embodiment. In the third embodiment, a function of securely unlocking the handle portion from the retraction position, which will be described below, is implemented when the door 10 is closed, not when the development cartridges 4*y* to 4*k* are attached to the development cartridge receiving portion 102. Therefore, in this embodiment, the handle portions 9R and 9L are positioned so as to be rotatable from the third position to the second position or to the first position while the development cartridges 4*y* to 4*k* are attached to the development cartridge receiving portion 102.

As illustrated in FIGS. 15A to 15C, each handle portion 9 includes an unlocking portion contact portion 9*a*. When the unlocking portion contact portions 9*a* are pressed by the unlocking portions 15, the handle portions 9R and 9L rotate from the third position to the second position. The unlocking portion contact portion 9*a* may have a shape other than that illustrated in FIGS. 15A to 15C as long as the unlocking portion contact portion 9*a* can function similarly.

Handle Portion Locking Portion

As illustrated in FIGS. 15A to 15C, as compared with the first embodiment, the position of the locking portion 11 is changed as a result of the change in the shape of the development cartridge 4 and the change in the position of the handle portion 9. Although the locking portion 11 is disposed at a different position, the locking portion 11 has the same shape and the same function as the locking portion 11 according to the first embodiment.

This embodiment includes the locking portions 11 as members that lock the handle portion 9 as in the case of the first embodiment. However, instead of the locking portions 11, the locking portions 14 according to the second embodiment may be included.

Unlocking Portion

Figure 17A:
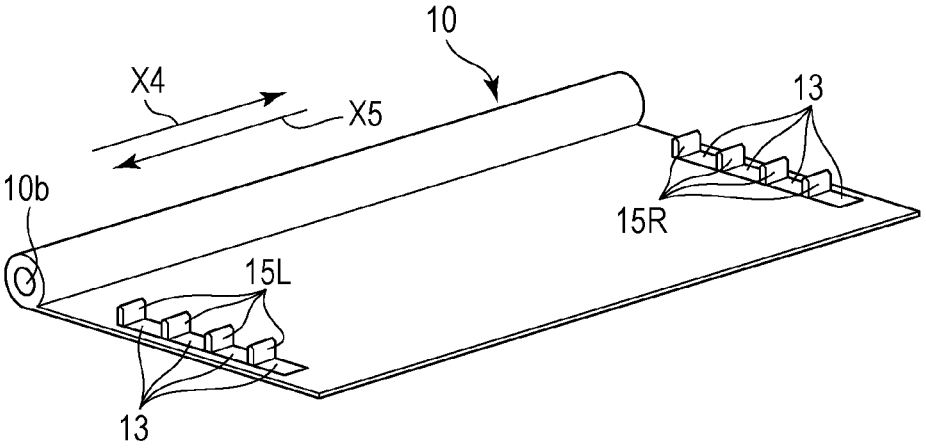
FIG. 17A is a perspective view of a door according to the third embodiment.
Figure 17B:
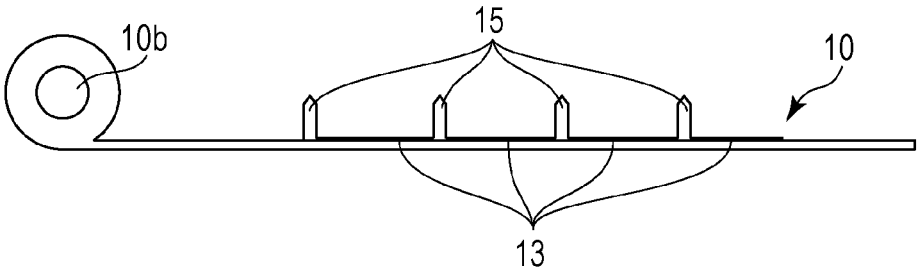
FIG. 17B is a left side view of the door according to the third embodiment.

As illustrated in FIGS. 17A and 17B, the unlocking portions 15R and 15L are attached to the inner surface of the door 10. Four unlocking portions 15R and four unlocking portions 15L are attached to the door so as to correspond to the handle portions 9R and 9L of the development cartridges 4*y* to 4*k*. The material of the unlocking portions 15R and 15L is not particularly specified. The unlocking portions 15R and 15L may be made of any material having such strength that the unlocking portions 15R and 15L are not damaged when coming into contact with the unlocking portion contact portions 9*a*.

As illustrated in FIG. 17B, the unlocking portions 15 extend perpendicularly to the inner surface of the door 10. The unlocking portions 15 may have different shapes when viewed in cross section as long as the unlocking portions 15 can function similarly. The length or the position of each unlocking portion 15 in the cross sectional direction (in the X4 and X5 directions) is not particularly specified. The unlocking portion 15 may have any length and may be positioned at any position as long as the unlocking portion 15 and the unlocking portion contact portion 9*a* can come into contact with each other to unlock the handle portion 9 when the door 10 is closed. The material of the unlocking portions 15 is not particularly specified. The unlocking portions 15 may be made of any material having such strength that the unlocking portions 15 are not damaged when the handle portion 9 is unlocked.

Secure Unlocking of Handle Portion from Retraction Position

Also in this embodiment, even when a user inserts the development cartridges 4*y* to 4*k* into the development cartridge receiving portion 102 with the handle portion 9 being at the third position, after the door is closed and opened, the handle portion 9 is moved to the first position.

Figure 18A:
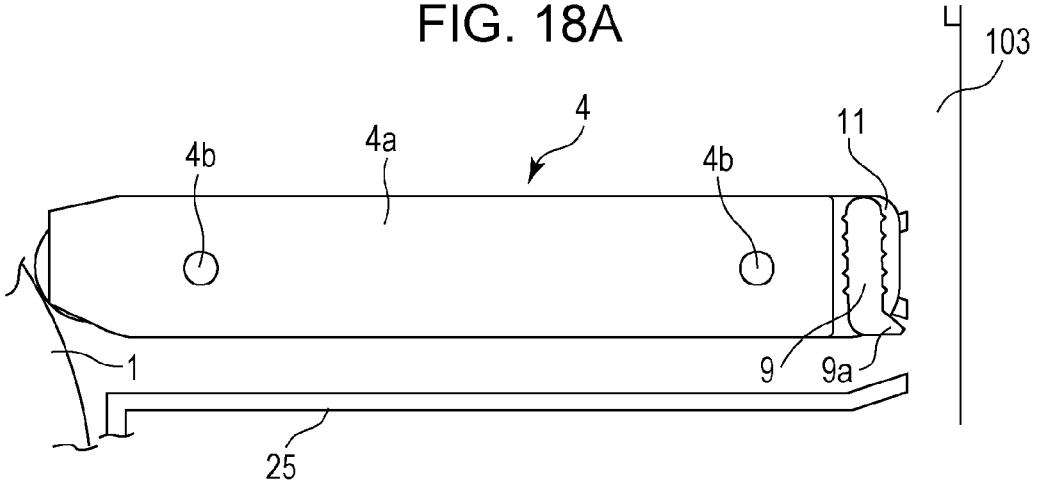
FIGS. 18A to 18C are left side views of the development cartridge according to the third embodiment with the handle portion being positioned at the third position in the course of the door being closed after the development cartridge is attached to the image forming apparatus body.
Figure 18B:
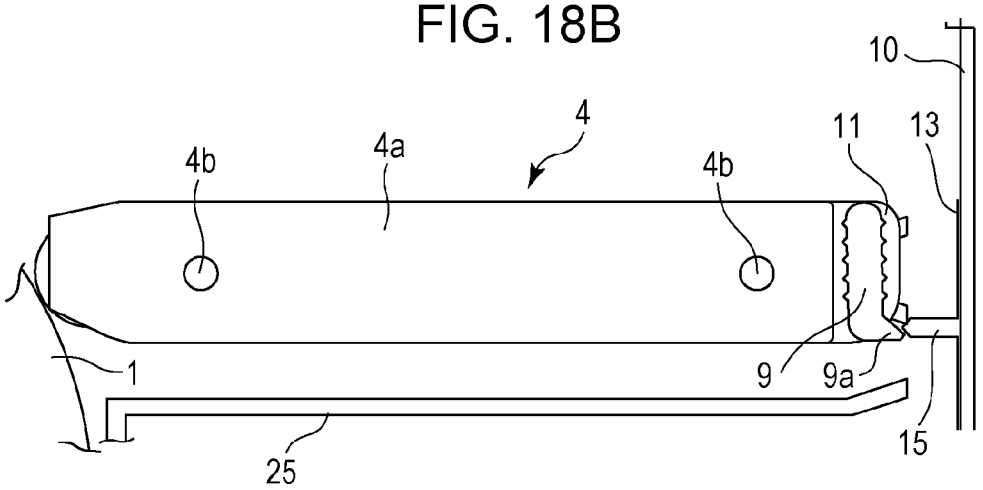
Figure 18C:
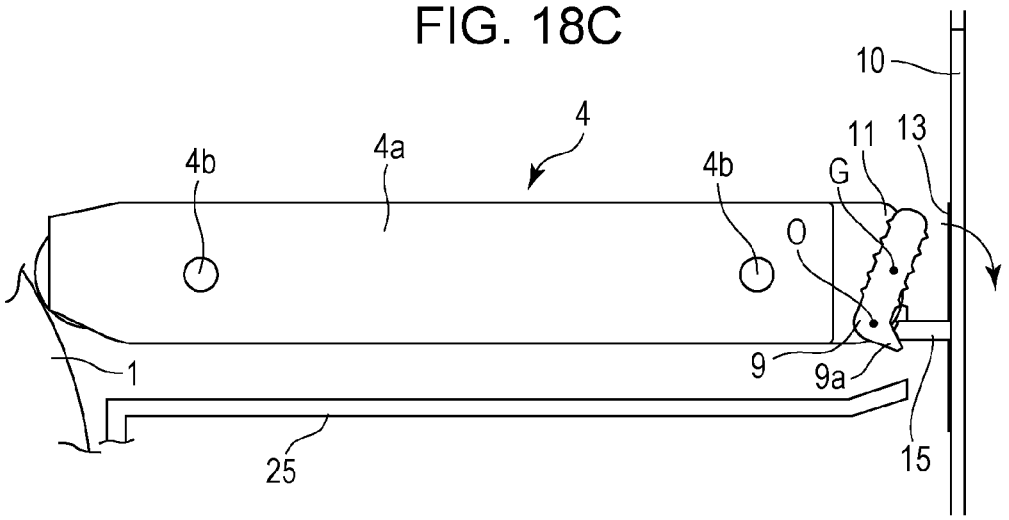

As illustrated in FIG. 18A, the case is assumed where the handle portion 9 is at the third position in the development cartridge 4. When the door 10 is closed with the development cartridge 4 being attached to the development cartridge receiving portion 102, as illustrated in FIG. 18B, the unlocking portion contact portion 9*a* of the handle portion 9 comes into contact with the unlocking portion 15 being attached to the door 10. When the door 10 is further closed until the door 10 completely covers the opening 103, the handle portion 9 is unlocked and starts rotating from the third position toward the first position. Here, as illustrated in FIG. 18C, the unlocking portion 15 presses the handle portion 9 and causes the handle portion 9 to rotate until the handle portion 9 has an angle that is smaller than 90° and at which the handle portion 9 and the locking portion 11 are not in contact with each other provided that the angle of the horizontal direction (X1 direction) is 0° and the angle of the vertical direction is 90°. After the angle of the handle portion 9 becomes smaller than 90°, the handle portion 9 rotates due to its weight to the second position at which the handle portion 9 comes into contact with the handle portion contact portion 13. Here, the handle portion 9 rotates due to its weight because, with the rotation of the handle portion 9 by the above-described angle, the center of gravity G of the handle portion 9 rotates to a position that is closer to the door 10 in the horizontal direction than the center of rotation O and that is above the center of rotation O in the vertical direction. Thereafter, when the door 10 is opened, the handle portion 9 rotates toward the first position with its weight. Here, the door 10 and the handle portion 9 rotate together while they are in contact with each other. When the development cartridges 4*y* to 4*k* have been completely attached to the development cartridge receiving portion 102 and after the door 10 is closed and opened once, the handle portion 9 is at the first position. With this configuration, even when a user attaches the development cartridge 4 to the development cartridge receiving portion 102 with the handle portions 9R and 9L being locked by the locking portion at the third position, the handle portions 9R and 9L are moved to the first position by closing and opening the door 10. Consequently, to remove the development cartridges 4*y* to 4*k*, a user does not have to insert his/her hand into the image forming apparatus body 101 and rotate the handle portions 9R and 9L to the first position.

Configuration of Door

As illustrated in FIGS. 15A to 15C, the handle portion contact portions 13 are attached to the inner surface of the door 10 that faces the inside of the image forming apparatus body 101 when the door 10 is closed. In the third embodiment, the handle portion contact portions 13 have substantially the same shape and are disposed in the same area as those according to the first embodiment. The handle portion contact portions 13 are not disposed in areas of the door 10 in which the unlocking portions 15 are disposed.

Other Configuration

In the embodiments, a development cartridge that is attachable to and detachable from the image forming apparatus body is described, but the present invention is not limited to this. This application of the invention is applicable to any cartridge that is attachable to and detachable from the image forming apparatus body. For example, the invention is applicable to a cleaning cartridge that is a cleaning device attachable to and detachable from the apparatus body or applicable to a drum cartridge that is a photosensitive drum attachable to and detachable from the apparatus body. Alternatively, the invention is applicable to a process cartridge that is a single cartridge into which a photosensitive drum and a processing unit are integrated.

According to the above-described embodiments, a space for a cartridge required during transportation can be saved and the cartridge is easily graspable when the cartridge is attached to and detached from the apparatus body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-033412 filed Feb. 17, 2012, which is hereby incorporated by reference herein in its entirety.

What is claimed is:

1. An image forming apparatus comprising:

an image forming apparatus body; and a cartridge that is attachable to and detachable from the image forming apparatus body, wherein the image forming apparatus body includes an open-close portion that is opened and closed to uncover and cover an opening through which the cartridge is attached to the image forming apparatus body, wherein the cartridge includes a case body, a locking portion provided on the case body, and a handle portion, the handle portion being attached to the case body and grasped when the cartridge is attached to and detached from the image forming apparatus body, wherein the handle portion is capable of being positioned at a first position, a second position, and a third position, the first position being one at which a tip of the handle portion protrudes beyond the case body, the second position being one at which the tip of the handle portion is closer to the case body than in the case where the handle portion is at the first position, the second position being one at which the cartridge that has been attached to the image forming apparatus body comes into contact with the open-close portion when the open-close portion is closed, and the third position being one at which the tip of the handle portion is closer to the case body than in the case where the handle portion is at the second position, and wherein the handle portion is locked by the locking portion at the third position so as not to move from the third position to the second position.

2. The image forming apparatus according to claim 1, wherein when the cartridge with the handle portion positioned at the third position is attached to the image forming apparatus body and the open-close portion is closed, the handle portion is moved from the third position to the second position and comes into contact with the open-close portion.

3. The image forming apparatus according to claim 1, wherein the image forming apparatus body includes an unlocking portion that, when the cartridge with the handle portion positioned at the third position is attached to the image forming apparatus body, comes into contact with the handle portion and unlocks the handle portion from the locking portion.

4. The image forming apparatus according to claim 3, wherein the unlocking portion comes into contact with the handle portion during a process of moving the cartridge through the opening.

5. The image forming apparatus according to claim 3, wherein the unlocking portion is disposed on the open-close portion and the unlocking portion comes into contact with the handle portion during a process of changing a state of the open-close portion from an open state to a closed state.

6. The image forming apparatus according to claim 1, wherein, when a state of the open-close portion is changed from a closed state to an open state with the cartridge being attached to the image forming apparatus body, the handle portion is moved from the second position to the first position.

7. The image forming apparatus according to claim 6, wherein, when the state of the open-close portion is changed from the closed state to the open state, the handle portion is moved from the second position to the first position due to the weight of the handle portion.

8. The image forming apparatus according to claim 1, wherein the open-close portion includes a handle portion contact portion, the handle portion contact portion coming into contact with the handle portion when the cartridge is attached to the image forming apparatus body to hold the handle portion at the second position, and wherein the handle portion contact portion is an elastic component.

9. The image forming apparatus according to claim 1, wherein the handle portion is movable between the first position and the third position via the second position by rotation.

10. The image forming apparatus according to claim 1, wherein the image forming apparatus includes a photosensitive drum and the cartridge that is provided in a plurality to form a color image, and wherein the plurality of cartridges are a plurality of development cartridges that develop a latent image formed on the photosensitive drum.

11. A cartridge that is attachable to and detachable from an image forming apparatus body including an open-close portion that is openable and closeable to uncover and cover an opening through which the cartridge is attached to the image forming apparatus, the cartridge comprising:

a case body;

a locking portion provided on the case body; and a handle portion attached to the case body, the handle portion being grasped when the cartridge is attached to and detached from the image forming apparatus body, wherein the handle portion is capable of being positioned at a first position, a second position, and a third position, the first position being one at which a tip of the handle portion protrudes beyond the case body, the second position being one at which the tip of the handle portion is closer to the case body than in the case where the handle portion is at the first position, the second position being one at which the cartridge that has been attached to the image forming apparatus body comes into contact with the open-close portion when the open-close portion is closed, and the third position being one at which the tip of the handle portion is closer to the case body than in the case where the handle portion is at the second position, and wherein the handle portion is locked by the locking portion at the third position so as not to move from the third position to the second position.

12. The cartridge according to claim 11, wherein, when the cartridge with the handle portion positioned at the third position is attached to the image forming apparatus body and the open-close portion is closed, the handle portion is moved from the third position to the second position and comes into contact with the open-close portion.

13. The cartridge according to claim 11, wherein the handle portion includes an unlocking portion contact portion that comes into contact with an unlocking portion of the image forming apparatus body when the cartridge with the handle portion positioned at the third position is attached to the image forming apparatus body, and wherein when the unlocking portion comes into contact with the unlocking portion contact portion, the handle portion is unlocked from the locking portion.

14. The cartridge according to claim 13, wherein the unlocking portion contact portion comes into contact with the unlocking portion during a process of moving the cartridge through the opening.

15. The cartridge according to claim 13, wherein the unlocking portion is disposed on the open-close portion, and wherein the unlocking portion contact portion comes into contact with the unlocking portion during a process of changing a state of the open-close portion from an open state to a closed state.

16. The cartridge according to claim 11, wherein, when a state of the open-close portion is changed from a closed state to an open state with the cartridge being attached to the image forming apparatus body, the handle portion is moved from the second position to the first position.

17. The cartridge according to claim 16, wherein, when the state of the open-close portion is changed from the closed state to the open state, the handle portion is moved from the second position to the first position due to the weight of the handle portion.

18. The cartridge according to claim 11, wherein the handle portion is movable between the first position and the third position via the second position by rotation.

19. The cartridge according to claim 11, wherein the cartridge is a development cartridge that develops a latent image formed on a photosensitive drum.

* * * * *